US007252537B2

(12) United States Patent
Simon et al.

(10) Patent No.: US 7,252,537 B2
(45) Date of Patent: Aug. 7, 2007

(54) ELECTROMAGNETIC COUPLER REGISTRATION AND MATING

(75) Inventors: Thomas D. Simon, Southborough, MA (US); Rajeevan Amirtharajah, Providence, RI (US); John R. Benham, Hopkinton, MA (US); John Critchlow, Northborough, MA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/051,044

(22) Filed: Feb. 3, 2005

(65) Prior Publication Data

US 2005/0130458 A1 Jun. 16, 2005

Related U.S. Application Data

(62) Division of application No. 10/334,663, filed on Dec. 30, 2002, now Pat. No. 6,887,095.

(51) Int. Cl.
*H01R 3/00* (2006.01)

(52) U.S. Cl. ..... 439/489; 439/526; 439/910; 439/329; 439/260

(58) Field of Classification Search ..... 439/489, 439/526, 910, 680, 329, 260
See application file for complete search history.

(56) References Cited

U.S. PATENT DOCUMENTS 3,516,065 A 6/1970 Bolt et al.
3,609,633 A 9/1971 Hargett
3,619,504 A 11/1971 De Veer et al.
3,651,432 A 3/1972 Henschen et al.
3,671,917 A 6/1972 Ammon et al.
3,740,675 A 6/1973 Moore et al.
3,755,764 A 8/1973 Suzuki et al.
3,764,941 A 10/1973 Nick
3,786,418 A 1/1974 Nick
3,835,252 A 9/1974 Ananiades et al.
3,971,728 A 7/1976 Robinson
4,531,793 A * 7/1985 Hochgesang ..... 439/55
4,556,268 A 12/1985 Noschese
4,641,322 A 2/1987 Hasegawa et al.
4,654,843 A 3/1987 Roza et al.
4,768,971 A 9/1988 Simpson
4,819,001 A 4/1989 Ohe et al.
4,825,450 A 4/1989 Herzog (Continued)

FOREIGN PATENT DOCUMENTS

DE 1 574 593 7/1971

(Continued)

OTHER PUBLICATIONS

Crisp, R., "Direct Rambus Technology: The New Main Memory Standard," Nov./Dec. 1997 issue of IEEE Micro., pp. 18-28.

(Continued)

*Primary Examiner*—Truc Nguyen
(74) *Attorney, Agent, or Firm*—Fish & Richardson P.C.

(57) ABSTRACT

A system includes a first bus coupler element, a second bus coupler element, and a visual element associated with the second bus coupler element and including a transparent media enabling the second coupler element to be visually aligned with the first coupler element.

24 Claims, 17 Drawing Sheets

U.S. PATENT DOCUMENTS

| | | | | |
|---|---|---|---|---|
| 4,838,797 | A | 6/1989 | Dodier | |
| 4,876,535 | A | 10/1989 | Ballmer | |
| 4,904,879 | A | 2/1990 | Rudy, Jr. et al. | |
| 4,969,824 | A | 11/1990 | Casciotti | |
| 5,073,761 | A | 12/1991 | Waterman et al. | |
| 5,171,154 | A | 12/1992 | Casciotti et al. | |
| 5,179,438 | A | 1/1993 | Morimoto | |
| 5,190,461 | A * | 3/1993 | Oorui et al. | 439/63 |
| 5,197,888 | A | 3/1993 | Brodsky et al. | |
| 5,276,817 | A * | 1/1994 | Matschke et al. | 439/61 |
| 5,301,208 | A | 4/1994 | Rhodes | |
| 5,308,249 | A | 5/1994 | Renn et al. | |
| 5,315,617 | A | 5/1994 | Guida et al. | |
| 5,317,481 | A | 5/1994 | Hillis et al. | |
| 5,365,205 | A | 11/1994 | Wong | |
| 5,385,476 | A | 1/1995 | Jasper | |
| 5,432,486 | A * | 7/1995 | Wong | 333/109 |
| 5,454,730 | A | 10/1995 | Tozuka | |
| 5,470,240 | A | 11/1995 | Suzuki | |
| 5,621,913 | A | 4/1997 | Tuttle et al. | |
| 5,629,838 | A | 5/1997 | Knight et al. | |
| 5,638,402 | A | 6/1997 | Osaka et al. | |
| 5,641,310 | A | 6/1997 | Tiberio, Jr. | |
| 5,667,388 | A | 9/1997 | Cottrell | |
| 5,669,783 | A | 9/1997 | Inoue et al. | |
| 5,741,152 | A | 4/1998 | Boutros | |
| 5,781,414 | A | 7/1998 | Mills et al. | |
| 5,793,668 | A | 8/1998 | Krakovyak | |
| 5,838,727 | A | 11/1998 | Lyon et al. | |
| 5,844,213 | A | 12/1998 | Peysakhovich et al. | |
| 5,876,215 | A * | 3/1999 | Biernath et al. | 439/67 |
| 5,945,634 | A | 8/1999 | Shimirak et al. | |
| 5,946,198 | A | 8/1999 | Hoppe et al. | |
| 5,977,841 | A | 11/1999 | Lee et al. | |
| 6,005,895 | A | 12/1999 | Perino et al. | |
| 6,007,357 | A | 12/1999 | Perino et al. | |
| 6,016,086 | A | 1/2000 | Williamson et al. | |
| 6,039,595 | A | 3/2000 | Tseng et al. | |
| 6,084,883 | A | 7/2000 | Norrell et al. | |
| 6,088,741 | A | 7/2000 | Murata | |
| 6,091,739 | A | 7/2000 | Simonovich et al. | |
| 6,111,476 | A | 8/2000 | Williamson et al. | |
| 6,162,065 | A | 12/2000 | Benham | |
| 6,167,132 | A | 12/2000 | Krone et al. | |
| 6,218,916 | B1 | 4/2001 | Ishikawa et al. | |
| 6,246,729 | B1 | 6/2001 | Richardson et al. | |
| 6,262,998 | B1 | 7/2001 | Hogeboom | |
| 6,281,848 | B1 | 8/2001 | Nagumo et al. | |
| 6,333,719 | B1 | 12/2001 | Varadan et al. | |
| 6,373,712 | B1 | 4/2002 | Bailis et al. | |
| 6,446,152 | B1 | 9/2002 | Song et al. | |
| 6,449,308 | B1 | 9/2002 | Knight, Jr. et al. | |
| 6,493,190 | B1 | 12/2002 | Coon | |
| 6,496,886 | B1 | 12/2002 | Osaka et al. | |
| 6,498,305 | B1 * | 12/2002 | Marketkar et al. | 174/250 |
| 6,498,512 | B2 | 12/2002 | Simon et al. | |
| 6,533,586 | B2 * | 3/2003 | Marketkar et al. | 439/38 |
| 6,546,055 | B1 | 4/2003 | Schmikl et al. | |
| 6,576,847 | B2 * | 6/2003 | Marketkar et al. | 174/255 |
| 6,623,292 | B1 | 9/2003 | Holler et al. | |
| 6,625,682 | B1 | 9/2003 | Simon et al. | |
| 6,697,420 | B1 | 2/2004 | Simon et al. | |
| 6,836,016 | B2 * | 12/2004 | Marketkar et al. | 257/726 |
| 7,075,996 | B2 | 7/2006 | Simon et al. | |
| 7,080,186 | B2 | 7/2006 | Simon et al. | |
| 2001/0024888 | A1 | 9/2001 | Marketkar et al. | |
| 2001/0053187 | A1 | 12/2001 | Simon et al. | |

FOREIGN PATENT DOCUMENTS

| | | |
|---|---|---|
| EP | 0 007 183 | 1/1980 |
| EP | 0 282 101 | 2/1994 |
| EP | 0 447 001 | 3/1997 |
| GB | 2 059 187 | 4/1981 |
| WO | 00/72163 | 11/2000 |

OTHER PUBLICATIONS

Farjad-Rad, Ramin et al., "A 0.3-μm CMOS 8-Gb/s 4-PAM Serial Link Transceiver," IEEE Journal of Solid-State Circuits, 35(5): 757-764 (May 2000).

Kaufer et al., Controlling crosstalk in high-speed digital systems, Electronic Systems, May 1999, pp. 31-35.

Knight, T.F. and D.B. Salzman, "Manufacturability of Capacitively Coupled Multichip Modules," 44th Electronic Components & Technology Conference, May 1994, pp. 605-608.

Knight, T.F., "Technologies for Low Latency Interconnection Switches," ACM Symposium on Parallel Algorithms and Architectures, Jun. 1989, pp. 351-358.

Osaka, Hideki, High Performance Memory Interface for DDR-SDRAM II: XTL (Crosstalk Transfer Logic), Hitachi Ltd., Systems Development Laboratory, pp. 1-20, vol. SDL601-XTL-0-074 DMX 006 (Sep. 15, 2000).

Osaka, Hideki, "XTL Evaluation System Evaluation Memory Sub-System: Chip (HS-TEG; High Speed Test Engineering Group) and DIMM," Sep. 15, 2000, pp. 1-14, vol. SDL601-XTL-0-073 DMX 005 Systems Development Laboratory, Hitachi Ltd.

Salzman, D.B. and T.F. Knight, "Capacitively Coupled Multichip Modules," Proceedings of the 1994 International Conference on Multichip Moducles, Apr. 13-15, 1994, Currigan Hall, Denver, Colorado, pp. 487-494.

Stearns, Thomas H., *Flexible Printed Circuitry*, New York: McGraw-Hill Companies, Inc., pp. 109-110 and 232-235 (1996).

Yang, Chih-Kong Ken, et al., "A 0.5-μm CMOS 4.0-Gbit/s Serial Link Transceiver with Data Recovery Using Over-sampling," IEEE Journal of Solid-State Circuits, 33(5): 713-722 (May 1998).

* cited by examiner

ELECTROMAGNETIC COUPLER REGISTRATION AND MATING

CROSS-REFERENCE TO RELATED APPLICATIONS

This application is a divisional application (and claims the benefit of priority under 35 U.S.C. § 120) of U.S. patent application Ser. No. 10/334,663, filed Dec. 30, 2002 now U.S. Pat. No. 6,887,095. The disclosure of the prior application is considered part of (and is incorporated by reference in) the disclosure of this application.

BACKGROUND

A typical multi-drop signal distribution system includes a device at one end of a bus and multiple devices electrically coupled to the bus by respective couplings requiring direct metal to metal contact. Coupling the devices to the bus typically requires mechanical fixtures such as pins, card guides, latches, and other similar types of fixtures for registration and mating. Registration generally refers to lining up couplers on the device side and the bus side within alignment tolerances, while mating generally refers to providing adequate electronic connection between each device and the bus so that a signal can flow between them.

DESCRIPTION

Coupler registration and mating may be performed using various techniques using non-mechanical fixtures. Performing registration can include using transparent coupler elements to aid registration of couplers to lines or signal traces. The coupler elements may be transparent to human vision, machine vision, or both. Having a transparent coupling element on one or both sides of the coupler (e.g., transparent media on one or both side of the coupler that includes an electrically conductive line) allows the human or machine performing the registration to see through the elements and properly align the coupler using conductive lines of the coupler or fiducial marks such as tick marks, printed symbols, or the like on the coupler elements. Performing coupler mating can include introducing an adhesive material between the coupler elements to hold the coupler together enough to ensure proper mating.

Performing registration and mating without solely using alternatives to mechanical fixtures may be beneficial in applications having narrow or serial buses, applications having a small number of bus slots, applications where coupler mating is performed by hand such as with test probes, applications having test points and signals that cannot easily be anticipated, applications having modest bandwidth requirements that are accommodating to poor coupling control, and/or applications having other similar types of configurations. Examples of such applications include signaling to peripheral computer subsystems or optional connectors. Furthermore, performing registration and mating with alternatives to mechanical fixtures may be less expensive than with mechanical fixtures.

Before further discussing registration and mating techniques, an example system is described that includes couplers that may use alternative registration and mating techniques.

Figure 1:
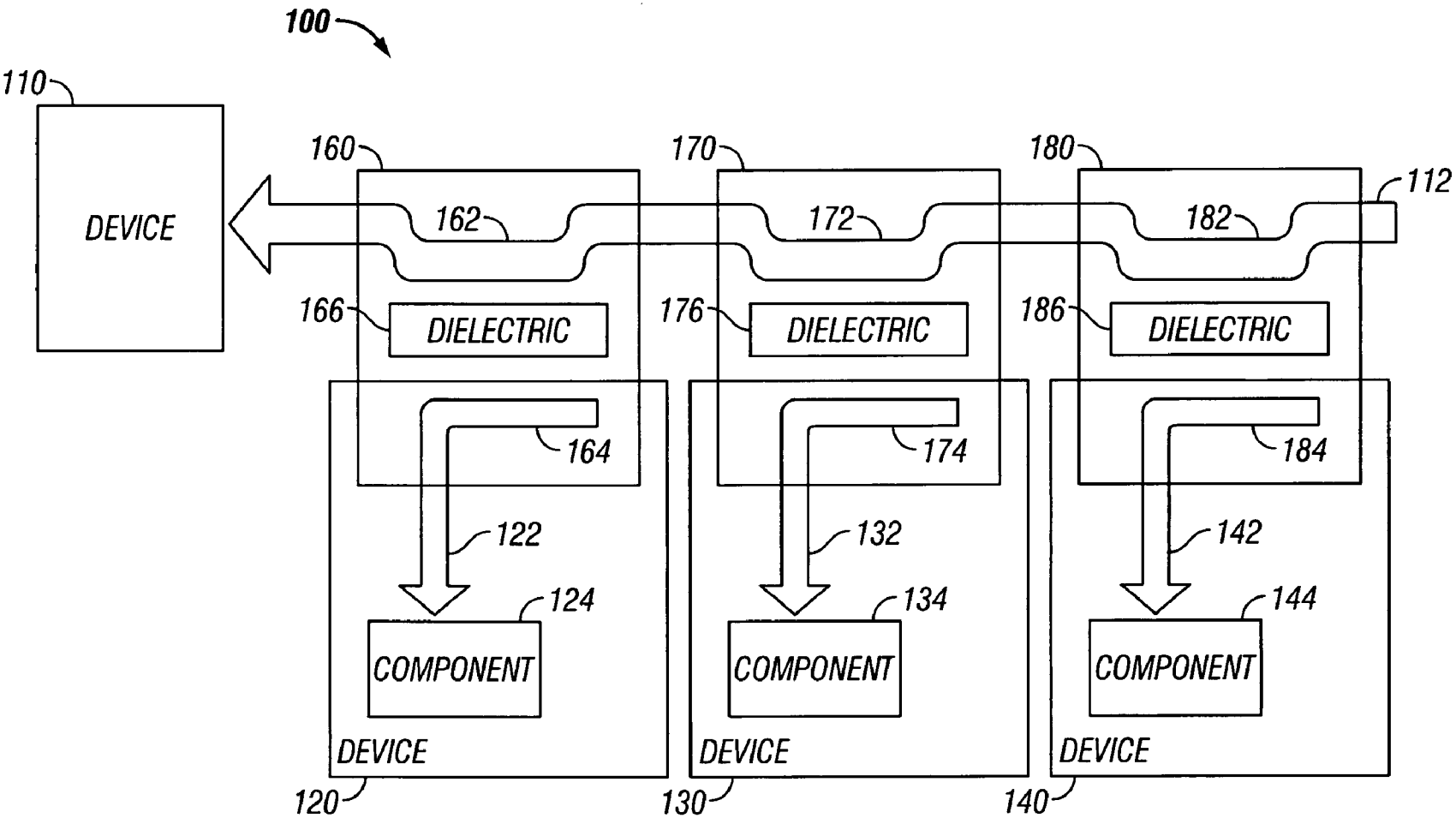
FIG. 1 shows an example multi-drop signal distribution system including a device electromagnetically coupled to other devices by respective electromagnetic couplers.

FIG. 1 illustrates a multi-drop signal distribution system 100 in which a device is electromagnetically coupled to other devices by respective electromagnetic couplers. The system 100 includes a device 110 and other devices 120, 130, and 140. Device 110 is coupled to a bus 112. Devices 120, 130, and 140 each include a bus 122, 132, and 142, respectively, and a component 124, 134, and 144, respectively. Buses 122, 132, and 142 are coupled to components 124, 134, and 144, respectively.

Devices 120, 130, and 140 are each electromagnetically coupled to bus 112 by an electromagnetic coupler 160, 170, and 180, respectively. Electromagnetic couplers 160, 170, and 180 electromagnetically couple buses 122, 132, and 142, respectively, to bus 112, allowing components 124, 134, and 144, respectively, to communicate with device 110. Electromagnetically coupling each device 120, 130, and 140 to bus 112 forms a data channel having substantially uniform electrical properties for transferring signals among devices 110, 120, 130, and 140 and allows use of relatively high frequency signaling without significantly increasing noise attributable to transmission line effects.

Although illustrated with three devices 120, 130, and 140 electromagnetically coupled to bus 112, bus 112 may have any length and may accommodate any number of devices. For example, bus 112 may be approximately fifty centimeters (cm) in length, allowing up to sixteen devices each to be electromagnetically coupled along approximately one cm of the length of bus 112 with each device spaced on a pitch of approximately 1.5 cm.

Each device 120, 130, and 140 may be fixedly or removably coupled to bus 112. As devices 120, 130, and 140 are electromagnetically coupled to bus 112, each device 120, 130, and 140 may be added to or removed from bus 112 with minimized effect on the communication bandwidth of bus 112.

Buses 112, 122, 132, and 142 may each include any number of lines of any conductive material. Devices 110, 120, 130, and 140 may each include any circuitry to perform any function. As one example, device 110 may include a memory controller and devices 120, 130, and 140 may each include a memory module. Devices 110, 120, 130, and 140 may communicate over buses 112, 122, 132, and 142 using any signaling scheme. Each device 110, 120, 130, and 140 may communicate using differential signal pairs to help reduce power and electromagnetic interference (EMI) and to help increase noise immunity.

Each component 122, 132, and 142 may include any circuitry. Each component 122, 132, and 142 may serve as an interface for each device 120, 130, and 140 to communicate with device 110.

Although illustrated in multi-drop signal distribution system 100, each device 120, 130, and 140 in other examples may communicate with device 110 in a point-to-point manner by electromagnetically coupling each device 120, 130, and 140 to a respective bus coupled to device 110.

In the example in FIG. 1, electromagnetic coupler 160 is formed by a portion 162 of the length of bus 112, a portion 164 of the length of bus 122, and a dielectric 166 between portions 162 and 164. Electromagnetic coupler 170 is formed by a portion 172 of the length of bus 112, a portion 174 of the length of bus 132, and a dielectric 176 between portions 172 and 174. Electromagnetic coupler 180 is formed by a portion 182 of the length of bus 112, a portion 184 of the length of bus 142, and a dielectric 186 between portions 182 and 184. Each of the dielectrics 166, 176, and 186 may include any dielectric material such as air, various polyimides, various epoxies, various polymeric materials, various plastics, various ceramics, polyethylene terephthalate (PET), polytetrafluoroethylene (PTFE) such as Teflon® by E. I. du Pont de Nemours and Company of Wilmington, Del., RT/Duroid® by World Properties, Inc. of Lincolnwood, Ill., alumina, and/or other similar types of materials. Each of the electromagnetic couplers 160, 170, and 180 may be formed to have any coupling coefficient, such as, e.g., in the range of approximately 0.15 to approximately 0.45.

Figure 2:
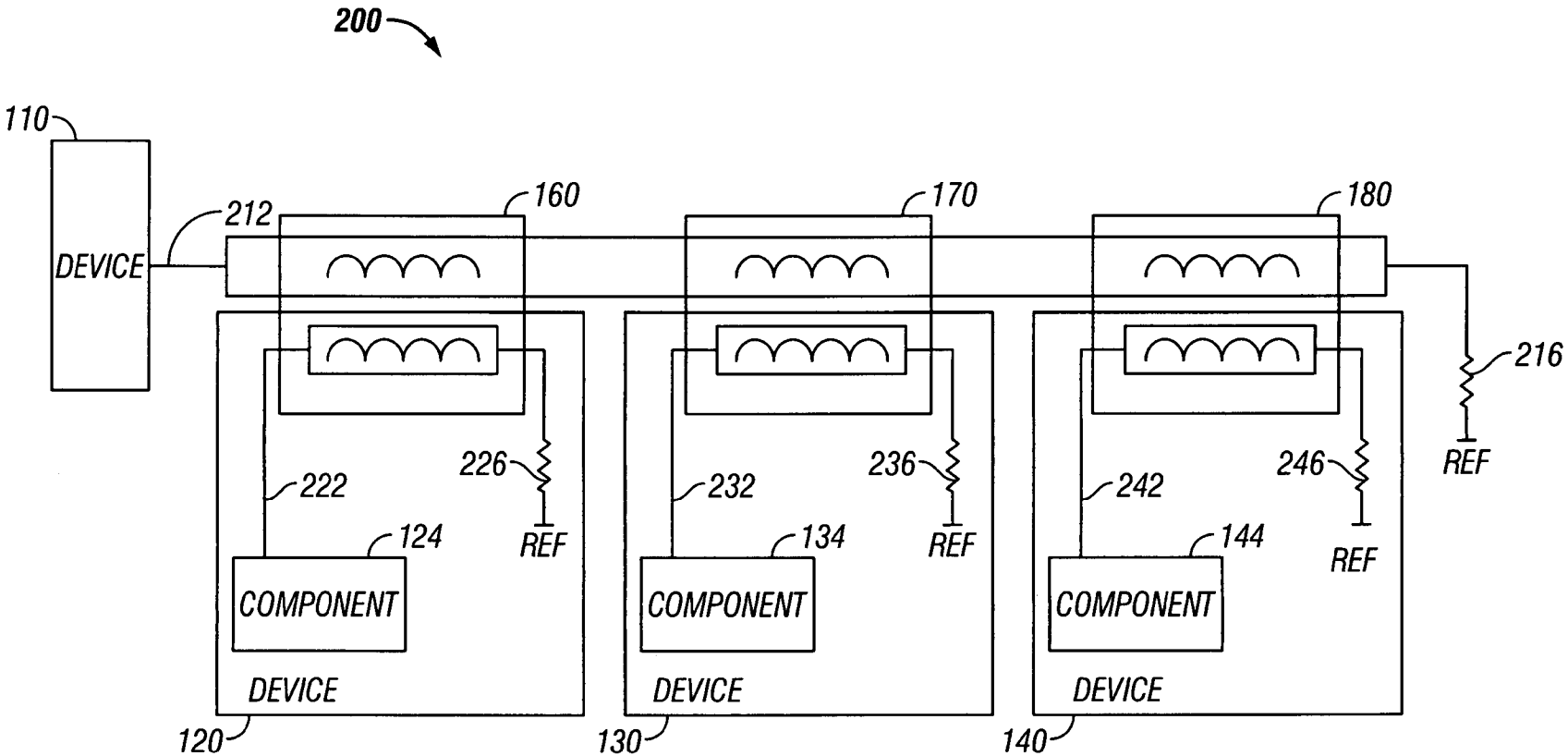
FIG. 2 shows an example electrical model of the electromagnetic couplers of FIG. 1.

FIG. 2 illustrates an example of an electrical model 200 for electromagnetic coupler 160 coupling a single conductive line 212 of bus 112 and a single conductive line 222 of bus 122, for electromagnetic coupler 170 coupling line 212 of bus 112 and a single conductive line 232 of bus 132, and for electromagnetic coupler 180 coupling line 212 of bus 112 and a single conductive line 242 of bus 142 (see also FIG. 1).

Lines 212, 222, 232, and 242 are each terminated with a parallel resistor 216, 226, 236 and 246, respectively, coupled between the end of its respective line 212, 222, 232, and 242 distant from device 110 and a voltage reference, such as ground. Resistors 216, 226, 236, and 246 may each have a resistance approximately equal to the characteristic impedance of their respective lines 212, 222, 232, and 242. Lines 212, 222, 232, and 242 are each terminated with a matched impedance for transmitting relatively high frequency signals.

As device 110 transmits a signal on line 212, a corresponding signal is induced on lines 22,2, 232, and 242 through electromagnetic couplers 160, 170, and 180, respectively, due to the electromagnetic fields generated by driving the signal on line 212. Similarly, as component 124, 134, or 144 transmits a signal on line 222, 232, or 242, respectively, a corresponding signal is induced on line 212.

Lines 222, 232, and 242 each absorb only a fraction of the power of a corresponding signal driven on line 212. Each line 222, 232, and 242 terminates the received power using resistor 226, 236, and 246, respectively. Similarly, line 212 absorbs only a fraction of the power of a corresponding signal driven on line 222, 232, and 242. Line 212 terminates the received power using resistor 216. Each electromagnetic coupler 160, 170, and 180 may absorb any amount of power depending, for example, on the amount of driven power and the coupling coefficient of the electromagnetic coupler. Each electromagnetic coupler 160, 170, and 180 may absorb less than approximately one percent of the power of a signal driven on any line coupled to the electromagnetic coupler. Because any capacitive load of devices 120, 130, and 140 and their respective lines 222, 232, and 242 are isolated from one another and from line 212, a generally constant impedance environment may be maintained on line 212 and any disturbance or impact of communication system parasitics on lines 212, 222, 232, and 242 is minimized or avoided.

Bus 112 may be mounted on or integrated in a circuit board, and device 110 may be mounted to or otherwise coupled to the circuit board such that device 110 is electrically coupled to bus 112. Each electromagnetic coupler 160, 170, and 180 may be formed by positioning bus portions 164, 174, and 184, respectively, relative to bus portions 162, 172, and 182 with dielectric 166, 176, and 186 between the electromagnetically coupled portions.

Figure 3:
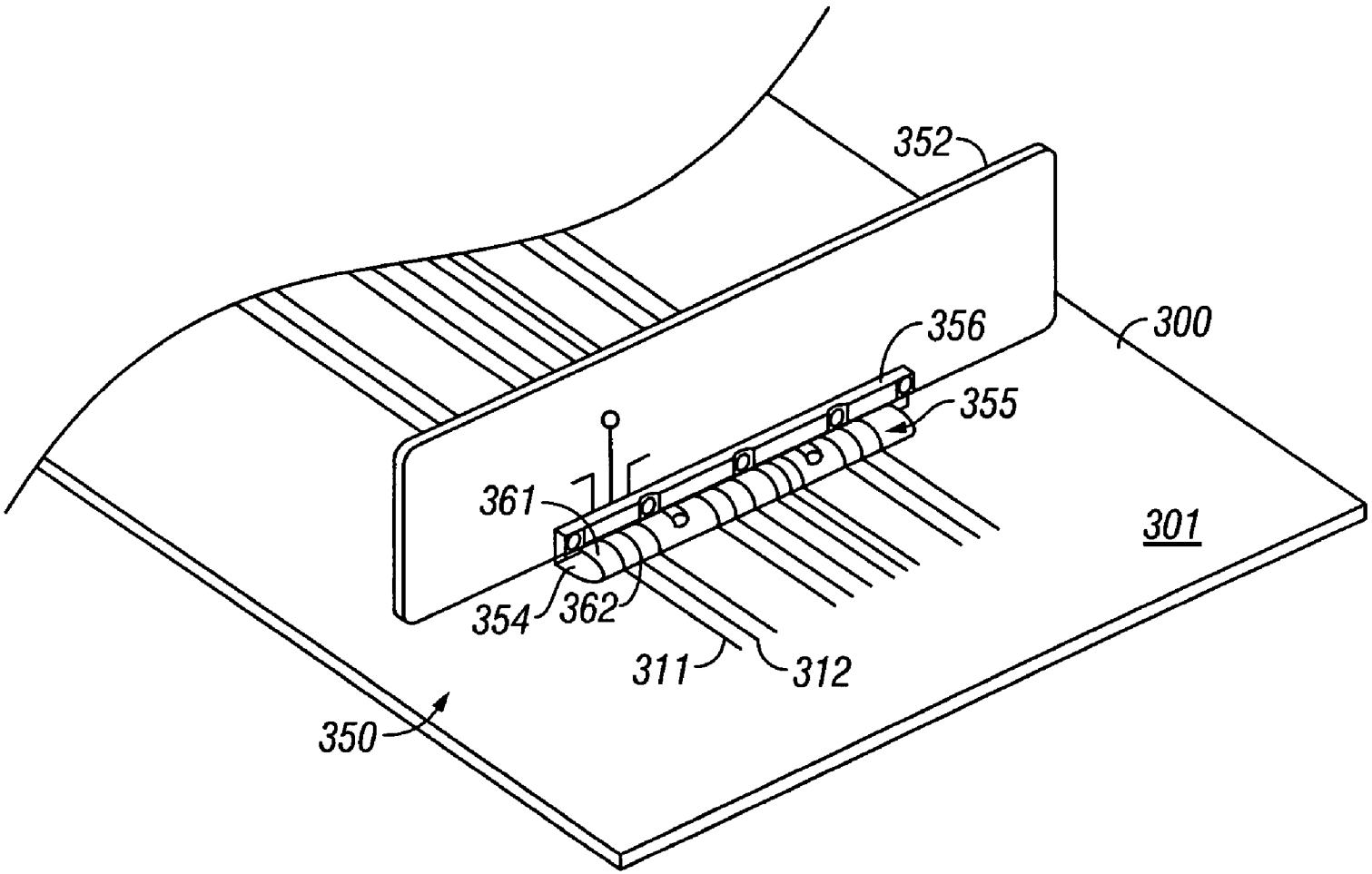
FIG. 3 shows an example of a device electromagnetically coupled to a circuit board.

Each device 120, 130, and 140 may be implemented in any manner, such as that of device 350 of FIG. 3 for example, to form electromagnetic couplers 160, 170, and 180, respectively. As illustrated in FIG. 3, device 350 is electromagnetically coupled to a circuit board 300 and includes a circuit board 352, a flex circuit 354, and a clamp 356 to secure flex circuit 354 to circuit board 352. Circuit board 300 and circuit board 352 may each include any circuitry, such as a motherboard for circuit board 300 and a daughter board for circuit board 352.

Circuit board 300 includes conductive lines for a bus, such as conductive lines 311 and 312 for bus 112. (Conductive lines 311 and 312 are two illustrative conductive lines included on circuit board 300.) Flex circuit 354 includes conductive lines, such as conductive lines 361 and 362, for example, which form at least a portion of bus 122, for example.

Conductive lines of circuit board 300 each include a respective conductive area to be positioned relative to a corresponding conductive area of a respective conductive line of flex circuit 354 with dielectric 166, for example, between such corresponding conductive areas to form an electromagnetic coupler such as electromagnetic coupler 160, for example. Corresponding conductive areas, such as those for conductive lines 311 and 361 for example, may be positioned by positioning a surface 355 of flex circuit 354 relative to a surface 301 of circuit board 300. For example, conductive lines of flex circuit 354 may each positioned relative to a respective corresponding conductive line of circuit board 300 with dielectric 166 between each pair of corresponding conductive lines along at least a portion of the length of each conductive line in each pair to form electromagnetic coupler 160. Electromagnetic coupler 160 may be formed with approximately one centimeter (cm) in length of each conductive line in each pair.

Dielectric 166 between each conductive area may include any dielectric material of any thickness. Dielectric 166 for one example may include one or more layers each including a dielectric material. Circuit board.300 and/or flex circuit 354 may each include at least a portion of dielectric 166. Circuit board 300 or flex circuit 354 may include dielectric 166. Circuit board 300 and flex circuit 354 for one example may each include a portion of dielectric 166.

Figure 4:
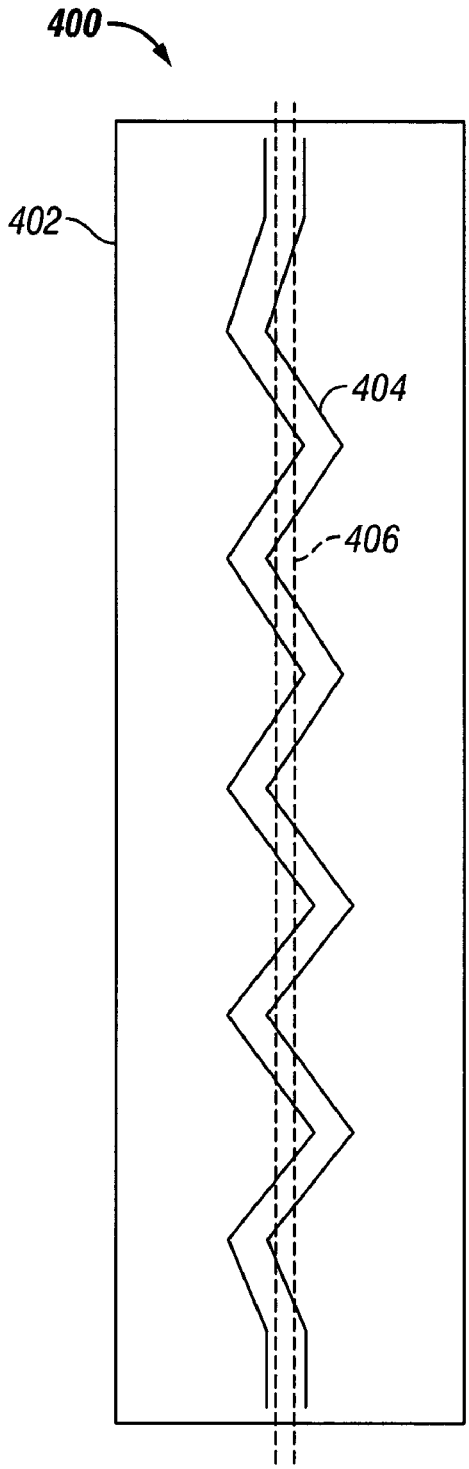
FIGS. 4 and 5 show examples of coupler alignment with transparent coupler media.

FIG. 4 illustrates an example of a coupler 400 included within a transparent media 402 that may help conductive areas to be visually positioned to form an electromagnetic coupler. A coupler trace 404 and a conductive line 406 (e.g., a test trace or conductive line on a circuit board or other similar media) are both visible through transparent media 402. This visibility allows the user (human or mechanical) to properly align coupler 400. Transparent media 402 may include fiducial marks at the end of the coupler that can be visually aligned with the conductive line 406 to help aid visual registration.

The transparency of transparent media 402 may be aided by making a voltage reference plane of a coupler perforated instead of solid. Voltage reference plane perforations may also be beneficial for electrical reasons such as impedance matching with particular choices of coupler to voltage reference plane dielectric thickness.

As an example of a device using couplers similar to coupler 400, flex circuit 354 of FIG. 3 may be a transparent media similar to transparent media 402. The conductive lines of flex circuit 354 such as conductive lines 361 and 362 would thus be visible through the transparent flex circuit and could be visually aligned with conductive lines of circuit board 300 such as conductive lines 311 and 312 to form electromagnetic couplers such as electromagnetic couplers 160, 170, and 180.

Figure 5:
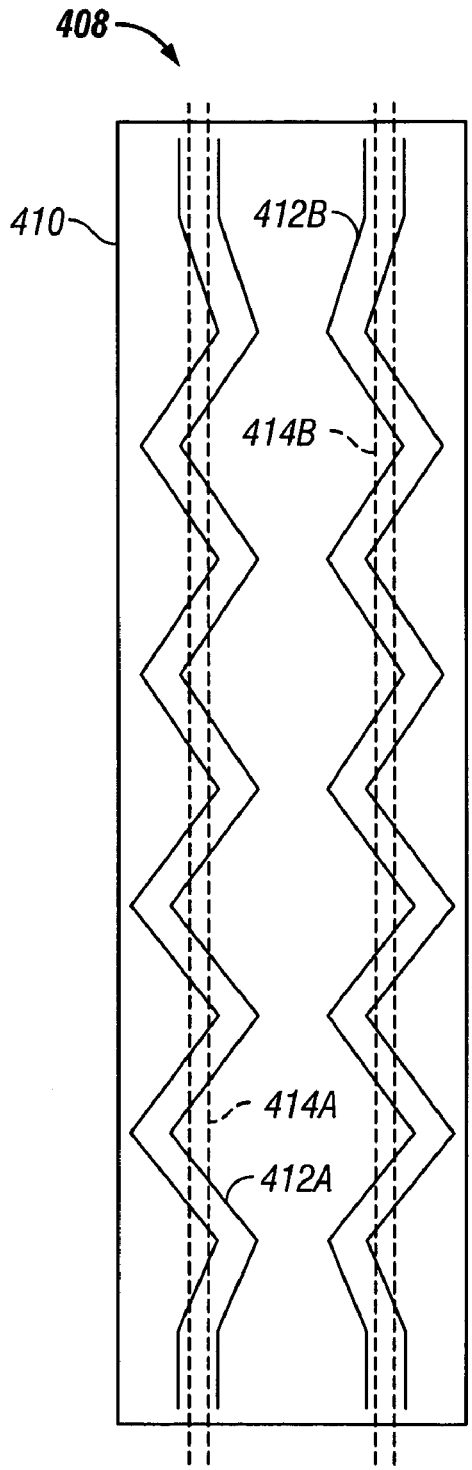

In another example, electromagnetic couplers 160, 170, and 180 may be implemented as differential coupler 408 as illustrated in FIG. 5. A differential coupler 408 included within a transparent media 408 includes visible differential coupler traces 412*a* and 412*b* and visible differential conductive lines 414*a* and 414*b*. Differential coupler 408 may be visually registered similar to the registration described for coupler 400 of FIG. 4.

Figure 6:
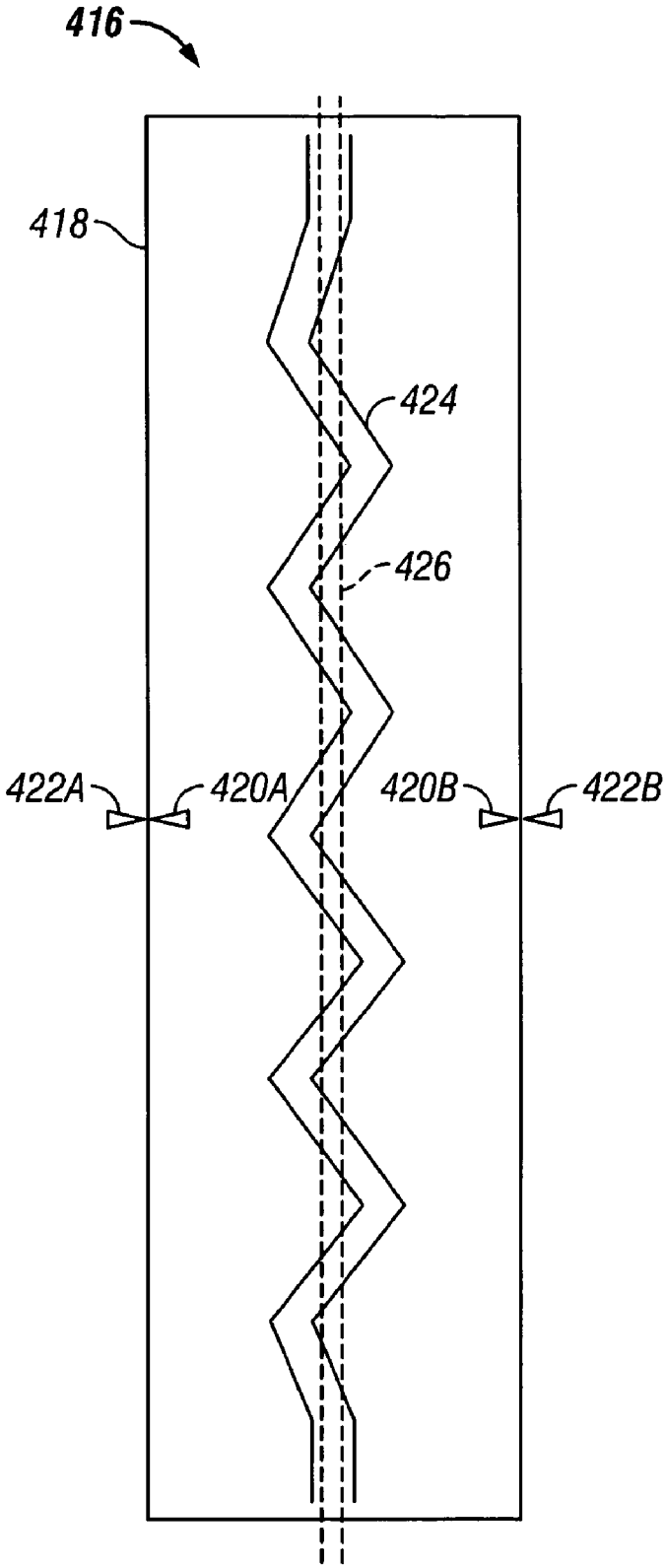
FIG. 6 shows an example of coupler alignment using fiducial marks.

In another example illustrated in FIG. 6, electromagnetic couplers 160, 170, and 180 may each be implemented as a coupler 416 included in a non-transparent media 418. Coupler 416 may be visually aligned using media-side fiducial marks 420*a-b* and board-side fiducial marks 422*a-b*. Even though coupler trace 424 and conductive line 426 are obscured from view when non-transparent media 416 is positioned over the media including conductive line 426, fiducial marks 420*a-b* and 422*a-b* may be aligned by a user (human or mechanical) to properly align coupler trace 424 and conductive line 426 to form a coupler.

Only two sets of media-side and board-side fiducial marks are shown in FIG. 6, but more fiducial marks may be used in any location to aid alignment. Furthermore, the fiducial marks are all shown as triangles, but the fiducial marks may be any combination of shapes (e.g., triangles, diamonds, rectangles, etc.) and/or lines.

Figure 7:
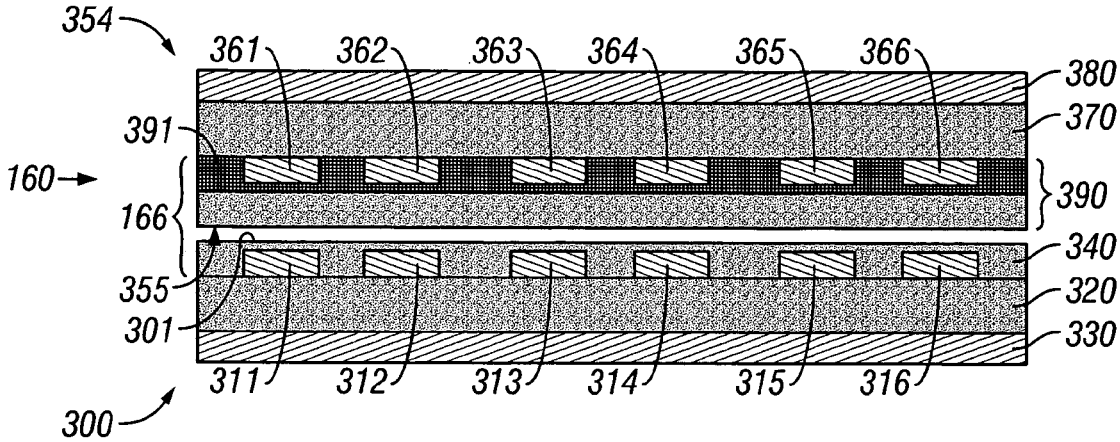
FIG. 7 shows a partial cross-sectional view of an example electromagnetic coupler formed by the device and circuit board of FIG. 3.

FIG. 7 illustrates an example of a partial cross-sectional view of circuit board 300 including a conductive layer including conductive lines 311, 312, 313, 314, 315, and 316 for bus 112, for example, and of flex circuit 354 including a conductive layer including conductive lines 361, 362, 363, 364, 365, and 366 for bus 122, for example. Each conductive line 361-366 is positioned relative to each conductive line 311-316 with dielectric 166 between each pair of corresponding conductive lines 311 and 361, 312 and 362, 313 and 363, 314 and 364, 315 and 365, and 316 and 366 to form electromagnetic coupler 160.

As illustrated in an example in FIG. 7, circuit board 300 includes a dielectric layer 320, a voltage reference layer 330, and a dielectric layer 340. Dielectric layer 320 is between voltage reference layer 330 and the conductive layer including conductive lines 311-316. Voltage reference layer 330 can help reduce electromagnetic interference (EMI) that may be generated by signals propagating through conductive lines 311-316. Dielectric layer 320 electrically insulates conductive lines 311-316 from voltage reference layer 330. The conductive layer including conductive lines 311-316 is between at least a portion of dielectric layer 320 and at least a portion of dielectric layer 340. Dielectric layer 340 lies adjacent to the conductive layer including conductive lines 311-316 opposite dielectric layer 320. Dielectric layer 340 forms at least a portion of dielectric 166 for electromagnetic coupler 160.

Dielectric layer 320 may include any dielectric or electrically insulating material and may include one or more layers of a dielectric material. Dielectric layer 320 may include a material that is also relatively rigid, such as a fiberglass epoxy material for example. One material is known as Flame Retardant 4 (FR4). Dielectric layer 320 may have any thickness. If dielectric layer 320 includes FR4, dielectric layer 320 may have a thickness of approximately five mils, for example.

Each conductive line 311-316 is positioned on a surface of dielectric layer 320. Conductive lines 311-316 may each include any conductive material, such as copper (Cu), a conductive plastic, or a printed conductive ink for example. Conductive lines 311-316 may each include one or more layers of a conductive material. Each conductive line 311-316 may have any thickness. If each conductive line 311-316 includes copper (Cu), each conductive line 311-316 may have a thickness of approximately two mils, for example.

Voltage reference layer 330 is positioned on a surface of dielectric layer 320 opposite conductive lines 311-316. Voltage reference layer 330 may include any conductive material, such as copper (Cu) or a conductive plastic for example, and may include one or more layers of a conductive material. Voltage reference layer 330 may have any thickness. If voltage reference layer 330 includes copper (Cu), voltage reference layer 330 may have a thickness of approximately 1.4 mils, for example.

Dielectric layer 340 lies adjacent to the conductive layer including conductive lines 311-316 and portions of the surface of dielectric layer 320 exposed by conductive lines 311-316. Dielectric layer 340 may include any dielectric material, such as an epoxy dielectric soldermask for example, and may include one or more layers of a dielectric material. Dielectric layer 340 may have any thickness. If dielectric layer 340 includes an epoxy dielectric soldermask, dielectric layer 340 may have a thickness of approximately one mil, for example, to approximately 1.5 mils, for example. Although illustrated as having a relatively flat surface 301, surface 301 may be contoured due to conductive lines 311-316.

Circuit board 300 may be manufactured in any manner using any techniques.

Flex circuit 354, as illustrated in the example in FIG. 7, includes a dielectric layer 370, a voltage reference layer 380, and a dielectric layer 390. Dielectric layer 370 is between voltage reference layer 380 and the conductive layer including conductive lines 361-366. Voltage reference layer 380 helps reduce electromagnetic interference (EMI) that may be generated by signals propagating through conductive lines 361-366. Dielectric layer 370 electrically insulates conductive lines 361-366 from voltage reference layer 380. The conductive layer including conductive lines 361-366 is between at least a portion of dielectric layer 370 and at least a portion of dielectric layer 390. Dielectric layer 390 lies adjacent to the conductive layer including conductive lines 361-366 opposite dielectric layer 370. Dielectric layer 390 forms at least a portion of dielectric 166 for electromagnetic coupler 160.

Dielectric layer 370 may include any dielectric or electrically insulating material and may include one or more layers of a dielectric material. Dielectric layer 370 may include a material that is also relatively flexible and/or resilient, such as an epoxy dielectric material or a polyimide for example. One polyimide is known as Kapton® by E.I. du Pont de Nemours and Company of Wilmington, Del. Another material may be polyethylene terephthalate (PET). Dielectric layer 370 may have any thickness. If dielectric layer 370 includes Kapton®, dielectric layer 370 may have a thickness of approximately four mils, for example.

Each conductive line 361-366 is positioned on a surface of dielectric layer 370. Conductive lines 361-366 may each include any conductive material, such as copper (Cu), a conductive plastic, or a printed conductive ink for example. Conductive lines 361-366 may each include one or more layers of a conductive material. Each conductive line 361-366 may have any thickness. If each conductive line 361-366 includes copper (Cu), each conductive line 361-366 may have a thickness of approximately 0.65 mils, for example.

Voltage reference layer 380 is positioned on a surface of dielectric layer 370 opposite conductive lines 361-366. Voltage reference layer 380 may include any conductive material, such as copper (Cu) or a conductive plastic for example, and may include one or more layers of a conductive material. Voltage reference layer 380 may have any thickness. If voltage reference layer 380 includes copper (Cu), voltage reference layer 380 may have a thickness of approximately 0.65 mils, for example.

Dielectric layer 390 lies adjacent to the conductive layer including conductive lines 361-366 and portions of the surface of dielectric layer 370 exposed by conductive lines 361-366. Dielectric layer 390 may include any dielectric material. Dielectric layer 390 may include a material that is also relatively flexible and/or resilient, such as an epoxy dielectric material or a polyimide for example. One polyimide is Kapton®. Another material may be a polymeric material or polyethylene terephthalate (PET). Dielectric layer 390 may have any thickness. Although illustrated as having a relatively flat surface 355, surface 355 may be contoured due to conductive lines 361-366.

Dielectric layer 390, as illustrated in the example in FIG. 7, includes a layer 391 including a acrylic or epoxy adhesive dielectric material and another layer 392 including a polyimide, such as Kapton® for example. Layer 391 lies adjacent to the conductive layer including conductive lines 361-366 and portions of the surface of dielectric layer 370 exposed by conductive lines 361-366. Layer 392 lies adjacent to layer 391. Layers 391 and 392 may each have any thickness. Layer 391 may have a thickness of approximately 0.5 mils, for example. If layer 392 includes Kapton®, layer 392 may have a thickness of approximately 0.5 mils, for example.

Flex circuit 354 may be manufactured in any manner using any techniques.

Positioning flex circuit 354 relative to circuit board 300 as illustrated in FIG. 7 forms electromagnetic coupler 160 with dielectric 166 between conductive lines 311-316 and 361-366, respectively, formed by the combination of dielectric layer 340 of circuit board 300, any ambient material such as air between flex circuit 354 and circuit board 300, and dielectric layer 390 of flex circuit 354.

Circuit board 300 may be manufactured without dielectric layer 340. Dielectric 166 may then be formed by the combination of dielectric layer 390 and any ambient material between flex circuit 354 and circuit board 300. Flex circuit 354 in another example may be manufactured without dielectric layer 390. Dielectric 166 may then be formed by the combination of dielectric layer 340 and any ambient material between flex circuit 354 and circuit board 300. Where circuit board 300 does not include dielectric layer 340 and where flex circuit 354 does not include dielectric layer 390, dielectric 166 may be formed by ambient material between flex circuit 354 and circuit board 300.

For example, a compliant liquid or gel dielectric material, such as a glycerine for example, may be used between flex circuit 354 and circuit board 300 to form at least a portion of dielectric 166. Such material may help fill any ambient space between flex circuit 354 and circuit board 300 and help provide dielectric consistency. If flex circuit 354 is to be fixed to circuit board 300, a adhesive dielectric material, such as an acrylic or epoxy for example, may be used to couple flex circuit 354 to circuit board 300 and form at least a portion of dielectric 166.

Circuit board 300 and flex circuit 354 may have conductive lines with any shape, dimensions, and spacings.

Figure 8:
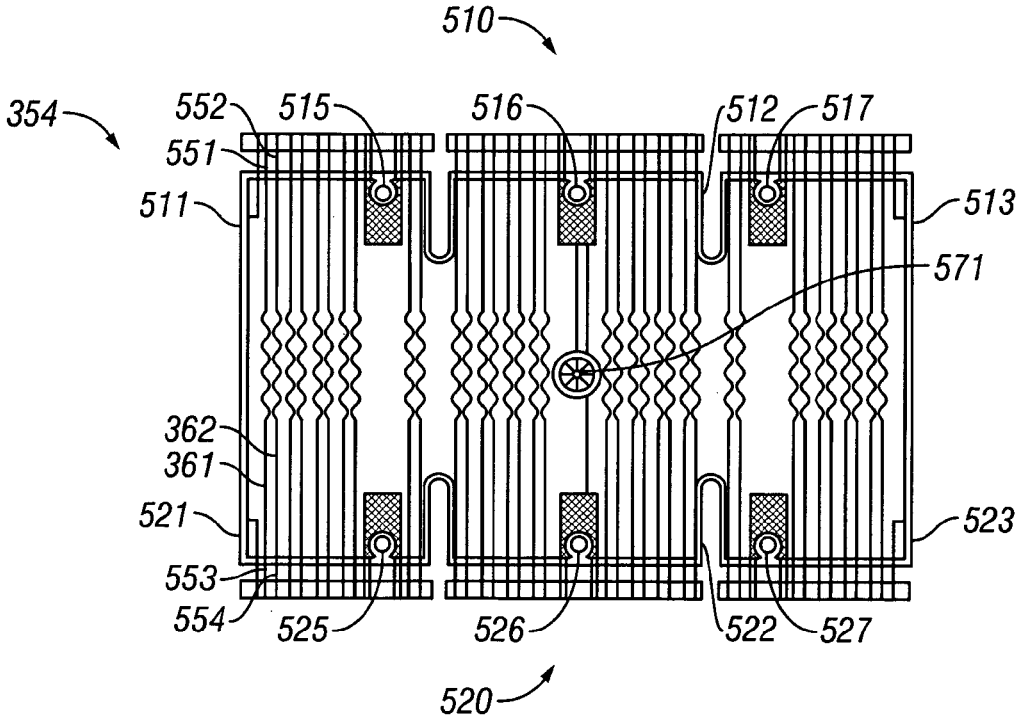
FIG. 8 illustrates an example flex circuit.

Conductive lines for flex circuit 354 in one example are relatively straight. For another example, as illustrated in FIG. 8, flex circuit 354 has lattice shaped conductive lines, such as conductive lines 361 and 362 for example, that are each formed from multiple connected segments generally lying in a plane with adjacent segments arranged with an alternating angular displacement about the longitudinal axis of the conductive line. Such lines for one example each has a width of approximately 0.01 inches and segments approximately 0.0492 inches in length along the longitudinal axis of the conductive line and angled at an approximately thirty-five degree angle relative to the longitudinal axis of the conductive line.

Conductive lines for circuit board 300 for one example are relatively straight. For another example, circuit board 300 has lattice shaped conductive lines that are each formed from multiple connected segments generally lying in a plane with adjacent segments arranged with an alternating angular displacement about the longitudinal axis of the conductive line. For one example where flex circuit 354 has lattice shaped conductive lines, conductive line segments for circuit board 300 are arranged with an alternating angular displacement in an opposite sense from corresponding conductive line segments of flex circuit 354. Such lines for one example each has a width of approximately 0.008 inches and segments approximately 0.0492 inches in length along the longitudinal axis of the conductive line and angled at an approximately thirty-five degree angle relative to the longitudinal axis of the conductive line.

Using lattice shaped conductive lines for flex circuit 354 and circuit board 300 helps allow conductive lines of flex circuit 354 to be positioned relative to corresponding conductive lines of circuit board 300 with a relatively uniform coupling area at overlap locations and helps minimize any impact on the desired coupling coefficient for electromagnetic coupler 160 despite some misalignment. If conductive lines for flex circuit 354 and circuit board 300 are relatively straight, corresponding conductive lines in each pair to be electromagnetically coupled may each have a different width to help compensate for any misalignment.

Although described as including flex circuit 354 to form electromagnetic couplers 160, 170, and 180 with circuit board 300, each device 120, 130, and 140 may include any carrier to help support bus 122, 132, and 142, respectively, for positioning relative to any carrier supporting bus 112. As examples, each device 120, 130, and 140 may support bus 122, 132, and 142 with a relatively rigid circuit board to position relative to a relatively rigid circuit board supporting bus 112 or to a flex circuit supporting bus 112. Each device 120, 130, and 140 may also support bus 122, 132, and 142 with a flex circuit to position relative to a flex circuit supporting bus 112.

Flex circuit 354 for one example is conductively coupled to circuit board 352 such that one end of each conductive line for flex circuit 354 is conductively coupled to communication circuitry on circuit board 352 to transmit and receive signals and such that the other end of each such conductive line is terminated on circuit board 352. If flex circuit 354 includes voltage reference layer 380, voltage reference layer 380 may be conductively coupled to a reference voltage on circuit board 352. Flex circuit 354 may be mechanically and conductively coupled to circuit board 352 in any manner.

Figure 9:
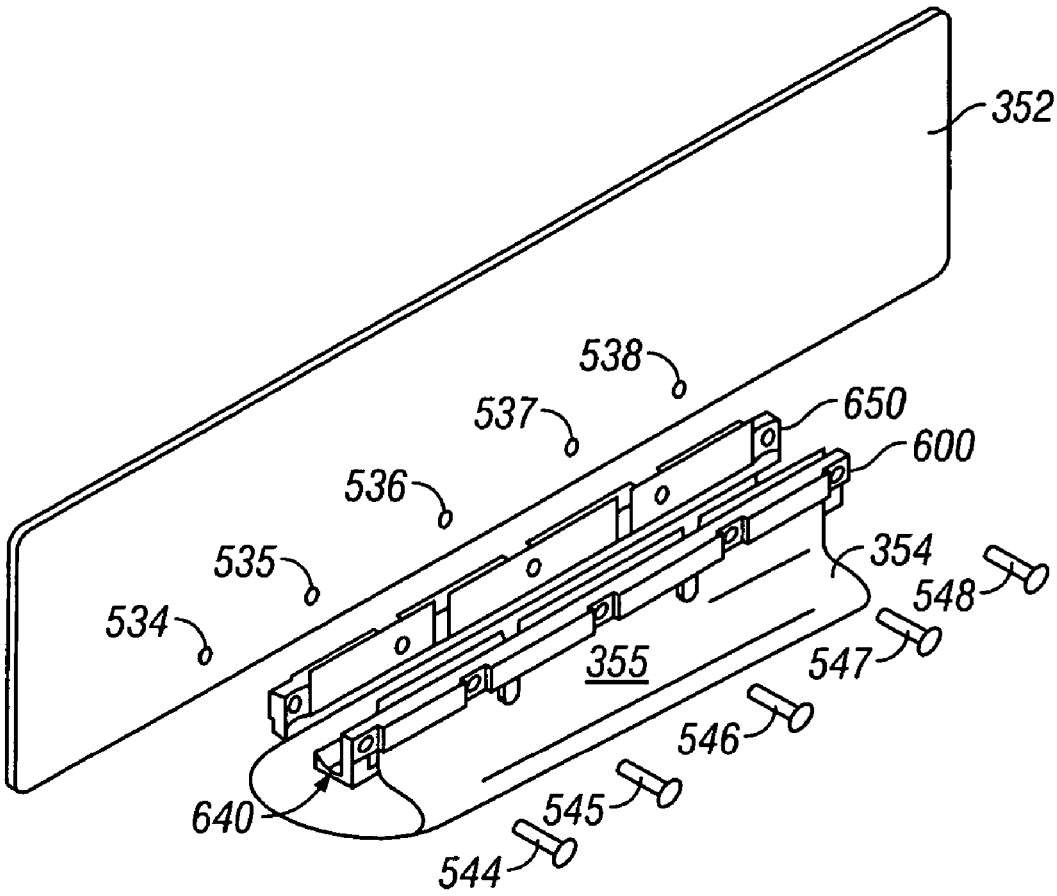
FIG. 9 illustrates an exploded perspective view of the example device of FIG. 3.
Figure 10:
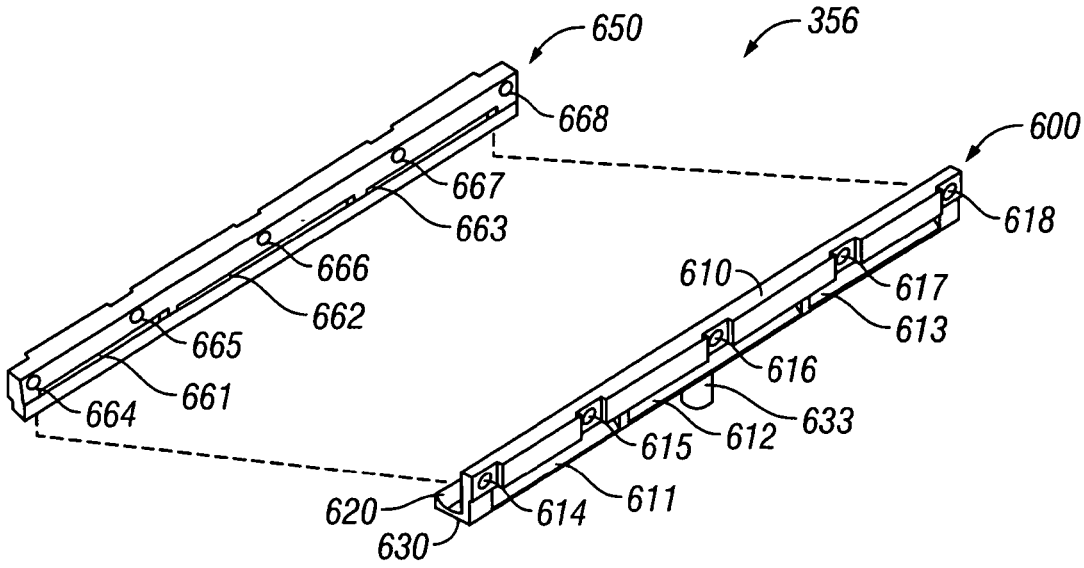
FIG. 10 illustrates an example exploded perspective view of the top and one side of a clamp to clamp a flex circuit to a circuit board.
Figure 11:
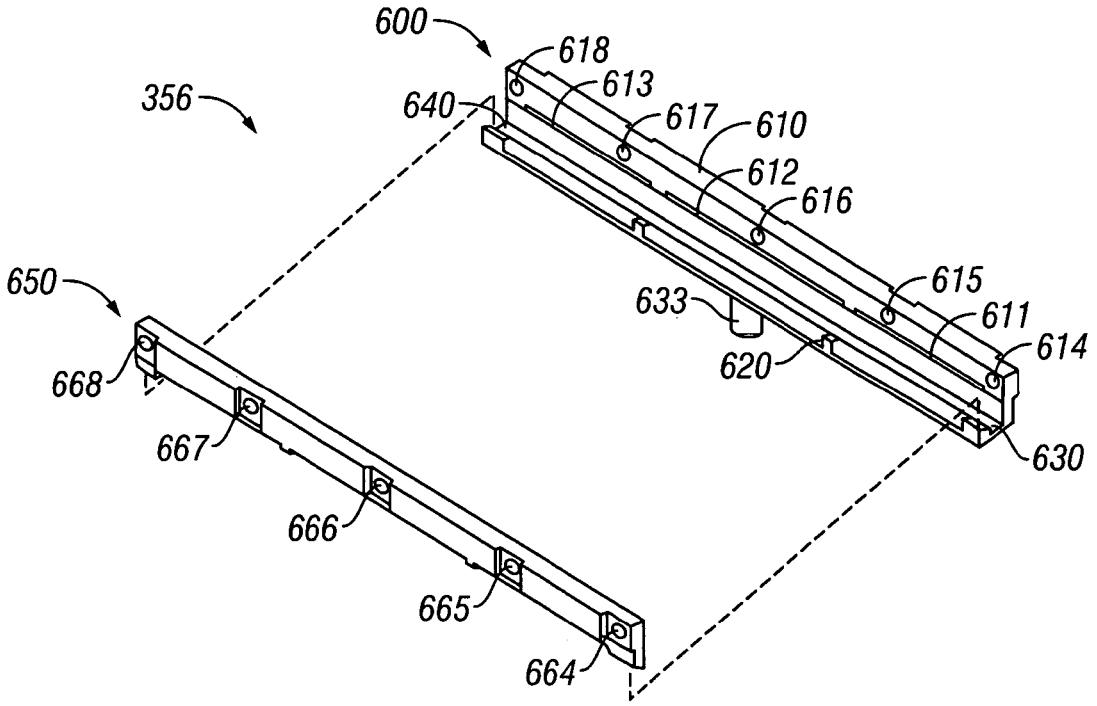
FIG. 11 shows an exploded perspective view of the top and another side of the example clamp of FIG. 10.
Figure 12:
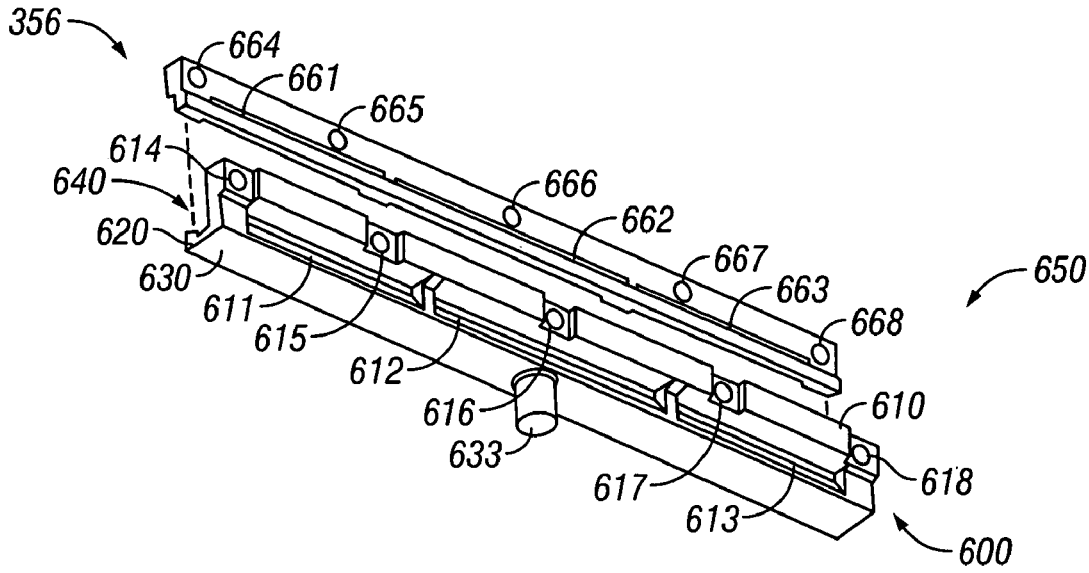
FIG. 12 shows an exploded perspective view of the bottom and one side of the example clamp of FIG. 10.

As illustrated in the example in FIGS. 3 and 9, flex circuit 354 is mechanically secured to circuit board 352 using clamp 356. Clamp 356 engages a bottom edge of circuit board 352 and mechanically secures opposite ends 510 and 520 of flex circuit 354 to opposite surfaces of circuit board 352. In securing flex circuit 354 to circuit board 352, clamp 356 helps support flex circuit 354 for stress relief for conductive coupling to circuit board 352 and helps align circuit board 352 relative to circuit board 300 in electromagnetically coupling device 350 to circuit board 300.

Figure 13:
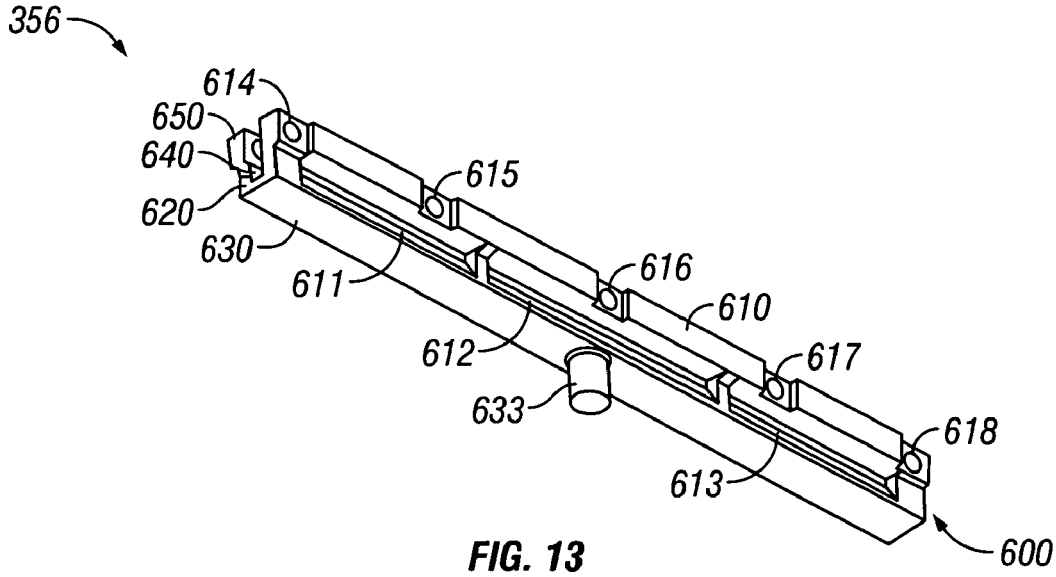
FIG. 13 shows a perspective view of the example clamp of FIG. 10.

Clamp 356, as illustrated in FIGS. 9, 10, 11, 12, and 13, includes two elongated pieces 600 and 650. Piece 600 defines a wall 610 along one side of piece 600, a raised edge 620 along the other side of piece 600, and a bottom wall 630. Wall 610, raised edge 620, and bottom wall 630 define a channel 640. The bottom of piece 650 mates with the top of raised edge 620, as illustrated in FIG. 13, to form a body for clamp 356. When mated with piece 600, piece 650 forms a wall opposite wall 610 from channel 640. A bottom edge of circuit board 352 may be inserted into channel 640, as illustrated in FIG. 9, such that wall 610 and the wall defined by piece 650 face opposite surfaces of circuit board 352.

Piece 600 defines along wall 610 slots 611, 612, and 613 each extending through wall 610 near the bottom of wall 610 and openings 614, 615, 616, 617, and 618 each extending through wall 610 near the top of wall 610. Piece 650 similarly defines slots 661, 662, and 663 and openings 664, 665, 666, 667, and 668.

Pieces 600 and 650 may each include any material, such as an injection molded plastic for example, and may have any dimensions. For one example, piece 600 is approximately 2.844 inches in length, approximately 0.228 inches in width, and approximately 0.254 inches in height. Piece 650 for one example is approximately 2.844 inches in length, approximately 0.112 inches in width, and approximately 0.228 inches in height. Mated pieces 600 and 650 may optionally be bound together using, for example, an epoxy adhesive. Clamp 356 for another example may have one integral body shaped as mated pieces 600 and 650.

As illustrated in FIG. 8, flex circuit 354 in one example defines tabs 511, 512, and 513 and openings 515, 516, and 517 along one end 510 of flex circuit 354. Flex circuit 354 defines tabs 521, 522, and 523 and openings 525, 526, and 527 along an opposite end 520 of flex circuit 354. Flex circuit 354 may have any dimensions. In one example, flex circuit 354 is approximately 2.586 inches in length and approximately 1.828 in width.

To secure flex circuit 354 to circuit board 352, flex circuit 354 is rolled such that ends 510 and 520 are folded in toward the center of flex circuit 354 and away from the resulting curled surface of flex circuit 354, as illustrated in FIG. 9, such that dielectric layer 390 of flex circuit 354 defines an outer curled surface 355. Tabs 511, 512, and 513 are inserted through slots 611, 612, and 613, respectively, such that each tab 511, 512, and 513 extends from the exterior of wall 610 through slot 611, 612, and 613, respectively, to lie against the interior face of wall 610 and such that each opening 515, 516, and 517 of flex circuit 354 aligns with each opening 615, 616, and 617 of wall 610. Tabs 521, 522, and 523 are similarly inserted through slots 661, 662, and 663, respectively, such that each tab 521, 522, and 523 extends from the exterior of the wall defined by piece 650 through slot 661, 662, and 663, respectively, to lie against the interior face of the wall defined by piece 650 and such that each opening 525, 526, and 527 of flex circuit 354 aligns with each opening 665, 666, and 667 of the wall defined by piece. 650.

Circuit board 352 defines openings 534, 535, 536, 537, and 538 that align with openings 614-618, respectively, and with openings 664-668, respectively, when circuit board 352 is inserted into clamp 536. Openings 534-538 each extend through circuit board 352 between opposite surfaces of circuit board 352.

When circuit board 352 and flex circuit 354 are inserted into clamp 356, clamp 356 and flex circuit 354 may be secured to circuit board 352 by inserting screws or rivets 544, 545, 546, 547, and 548 through the aligned openings of clamp 356, flex circuit 354, and circuit board 352. For another example, piece 600 and/or piece 650 may be molded with screws or rivets to insert through aligned openings in flex circuit 354, circuit board 352, and opposite piece 600 or 650.

Although described as using three slots to receive three tabs at each end of flex circuit 354 and as using five openings to secure flex circuit 354 to circuit board 352 with five screws or rivets, any number of slots, tabs, and openings may be used.

Figure 14:
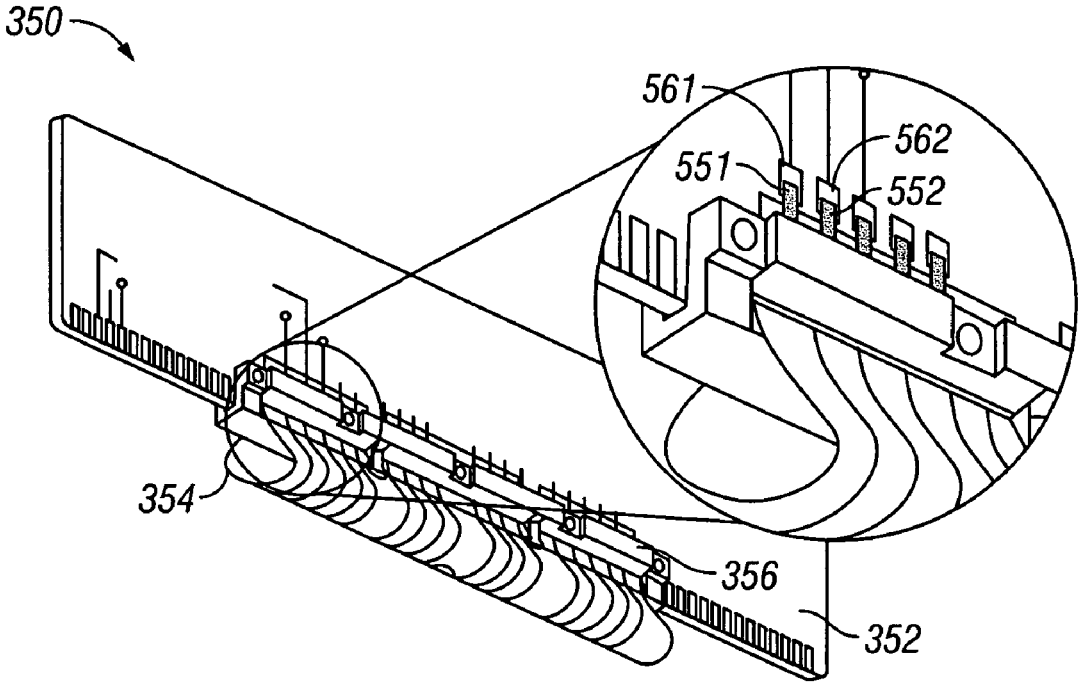
FIG. 14 shows an example electrical coupling of a flex circuit to a circuit board.

As illustrated in FIG. 9, flex circuit 354 for one example includes exposed leads, such as leads 551 and 552 for example, for each conductive line at each end 510 and 520 of flex circuit 354. Circuit board 352 for one example, as illustrated in FIG. 14, defines contact areas, such as contact areas 561 and 562 for example, that align with such leads when flex circuit 354 is secured to circuit board 352. Such contact areas on one surface of circuit board 352 are conductively coupled to electronic circuitry on circuit board 352, and such contact areas on the other surface of circuit board 352 are conductively coupled to terminate a respective conductive line of flex circuit 354 on circuit board 352. Leads of flex circuit 354 may each be conductively coupled to a respective contact area in any manner, such as using a hot bar soldering technique or using an epoxy adhesive for example.

As ends 510 and 520 of rolled flex circuit 354 may tend to pull away from circuit board 352 due to the resiliency of flex circuit 354, clamp 356 helps secure at least a portion of flex circuit 354 against circuit board 352. In this manner, any tendency of flex circuit 354 to move the secured portion away from circuit board 352 and pull leads of flex circuit 354 from contact areas of circuit board 352 is minimized or avoided.

Figure 15:
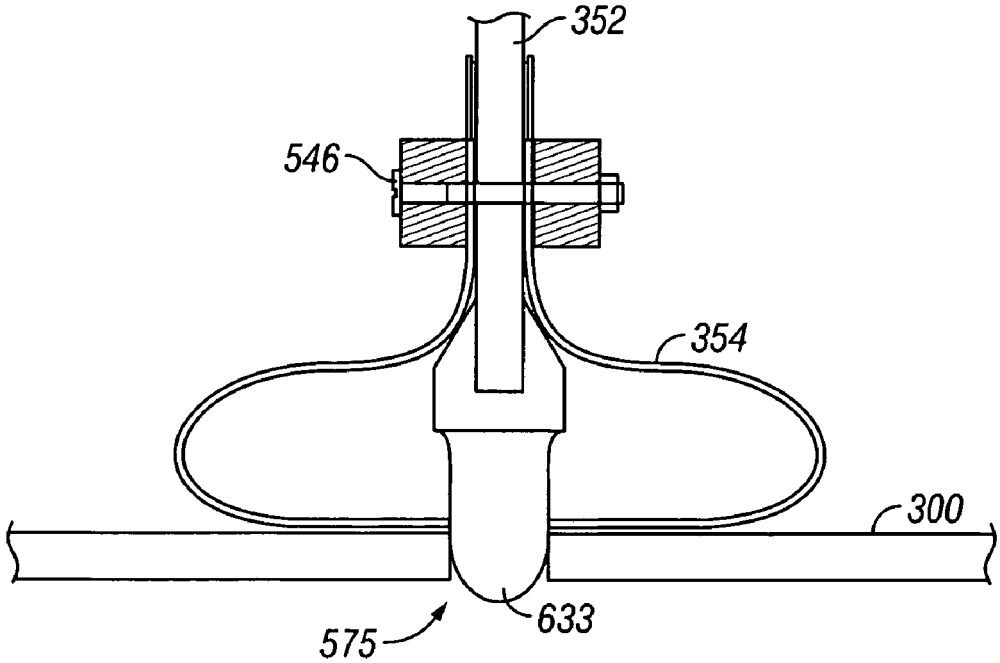
FIG. 15 shows an example partial cross-sectional view of a device electromagnetically coupled to a circuit board.

As illustrated in the examples in FIGS. 10-13, clamp 356 defines an optional alignment pin or post 633 extending outward from bottom wall 630. As flex circuit 354 is positioned against circuit board 300, as illustrated in FIG. 15, alignment post 633 may be inserted through an opening 571 in flex circuit 354, as illustrated in FIG. 8, and into an opening 575 in circuit board 300 to help align conductive lines of flex circuit 354 relative to conductive lines of circuit board 300. In another example, clamp 356 may define two or more alignment pins or posts to engage corresponding openings in flex circuit 354 and circuit board 300.

Flex circuit 354 for other examples may be secured to circuit board 352 in other manners. As examples, flex circuit 352 may be epoxied, screwed, riveted, or stapled directly to circuit board 352. Leads of flex circuit 354 may then be conductively coupled to a respective contact area of circuit board 352, for example, with an adhesive material such as solder, adhesive tape, epoxy, or similar adhesive materials. In other example, flex circuit 354 may be integrally formed with circuit board 352 or a chip on flex arrangement having a relatively rigid stiffener board may be used.

Figure 16:
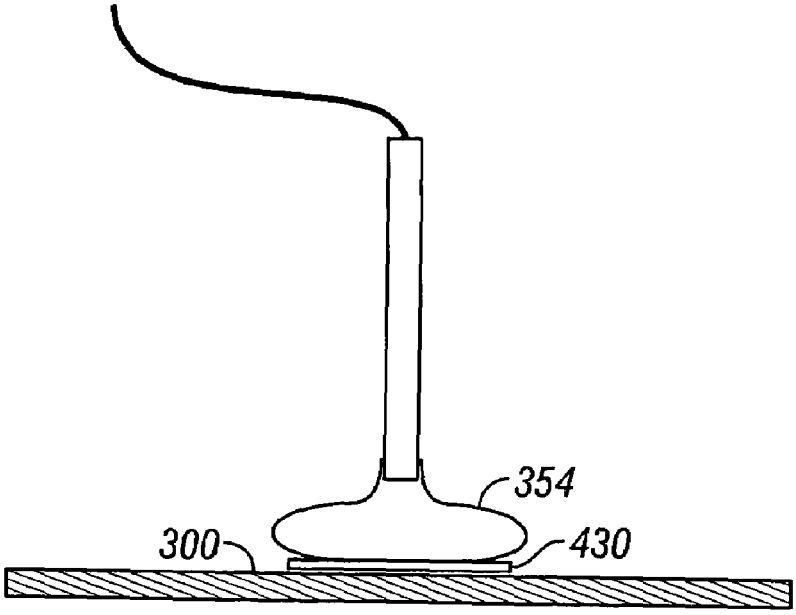
FIGS. 16 and 17 show example partial cross-sectional views of a device electromagnetically coupled to a board.

FIG. 16 illustrates an example mating scheme using an adhesive material 430 that can assist proper mating between flex circuit 354 and circuit board 300. As flex circuit 354 is positioned against circuit board 300, adhesive material 430 may aid connection between the conductive lines on flex circuit 354 and circuit board 300. Adhesive material 430 may also serve as a dielectric separator or be an add on. Adhesive material 430 is shown in this example on the flex circuit side, but adhesive material may be on either side of the coupler or on both sides.

Adhesive material 430 may be disposable and be replaced after each use, which may be beneficial in temporary coupler connection situations such as in test trace scenarios. For more permanent attachments, after adhesive material 430 is used to fix coupler position, an epoxy blanket (or similar mechanism) over the coupler and at least part of the circuit board 300 may be used to fix and mechanically bolster the coupler in place.

Figure 17:
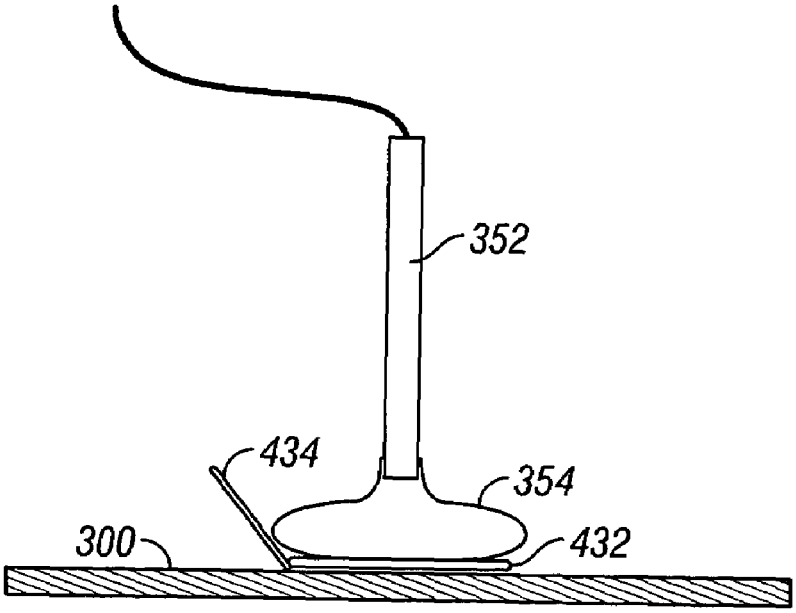

In another example illustrated in FIG. 17, a compliant material 432 and a lever 434 may assist proper mating between flex circuit 354 and circuit board 300. Examples of compliant materials include air bladders, diaphragms, and similar materials. As flex circuit 354 is positioned against circuit board 300, compliant material 432 and lever 434 may aid connection between the conductive lines on flex circuit 354 and circuit board 300. When circuit board 352 is placed against flex circuit 354, raising lever 434 expands the volume of compliant material 432 and the surrounding air pressure can exert downward force on the coupler to assist in proper mating.

In another example, flex circuit 354 may be attached onto a rigid card and that rigid card may be used as part of a C-clamp. The downward force could then be exerted by squeezing circuit board 300 between jaws of the clamp, compressing flex circuit 354 against the proper lines.

Circuit board 352 and flex circuit 354 may be positioned relative to circuit board 300 and coupled to circuit board 300 in any manner using any mechanism to form an electromagnetic coupler. As illustrated in the examples in FIGS. 18 and 19, a socket 700 may be used to mount circuit board 352 and flex circuit 354 relative to circuit board 300 to form an electromagnetic coupler. While circuit board 352 and flex circuit 354 are mounted by socket 700, the resilience of flex circuit 354 helps hold flex circuit 354 against circuit board 300 and therefore helps maintain a relatively stable coupling coefficient for the resulting electromagnetic coupler. In mounting circuit board 352 and flex circuit 354 to circuit board 300, socket 700 helps align circuit board 352 relative to circuit board 300 and helps align flex circuit 354 relative to circuit board 300. Socket 700 may also electrically couples circuit board 352 to circuit board 300.

As illustrated in FIGS. 18, 19, 20, 21, 22, 23, 24, and 25, socket 700 includes a base 710 near the bottom of sicket 700 and arms 730 and 740 extending from base 710 toward the top of socket 700 at opposite ends of base 710.

Base 710 includes a body 711 defining walls 712 and 713 on opposite sides of base 710 and adjacent to a coupler region 715 between walls 712 and 713. Base 710 also includes connectors 750 and 760 supported on opposite ends of coupler region 715 at opposite ends of base 710. Connectors 750 and 760 mount circuit board 352 to base 710 such that flex circuit 354 is inserted into coupler region 715. Connectors 750 and 760 also mount base 710 to circuit board 300 such that flex circuit 354 is mounted relative to circuit board 300 to form an electromagnetic coupler. Connectors 750 and 760 for one example also electrically couple circuit board 352 to circuit board 300.

As illustrated in the examples in FIGS. 18, 20, 23, and 25, connectors 750 and 760 each include an edge connector facing the top of socket 700. Circuit board 352 may be removably mounted to base 710 by inserting a bottom edge of circuit board 352 into the edge connector of connectors 750 and 760.

Figure 18:
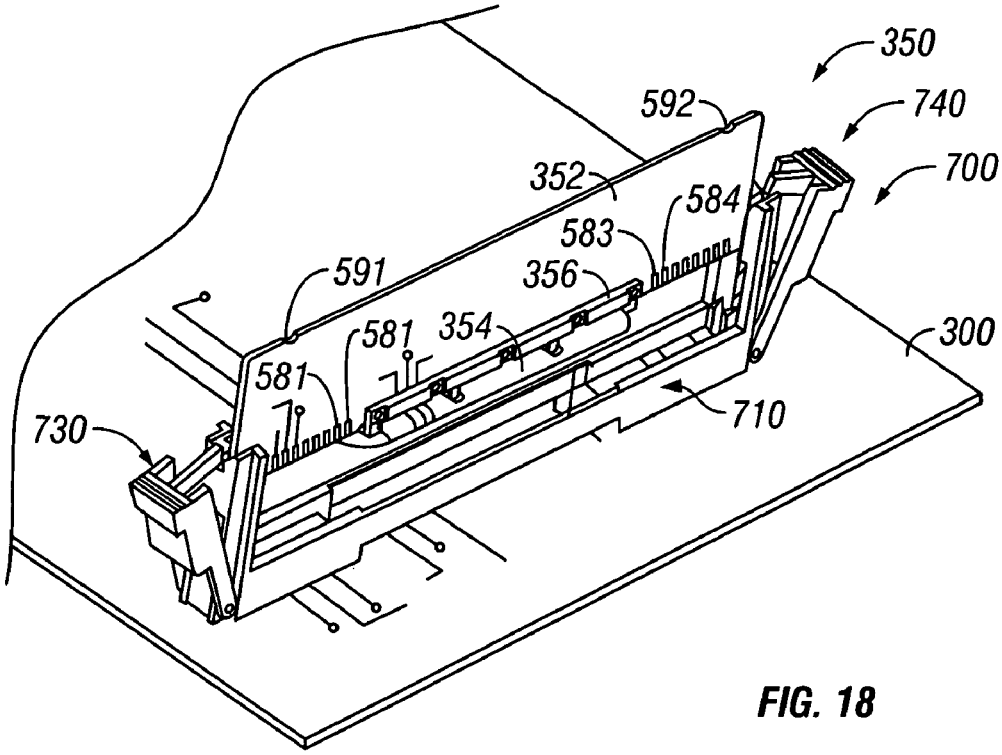
FIG. 18 shows an example perspective view of a device positioned for insertion into a socket.
Figure 19:
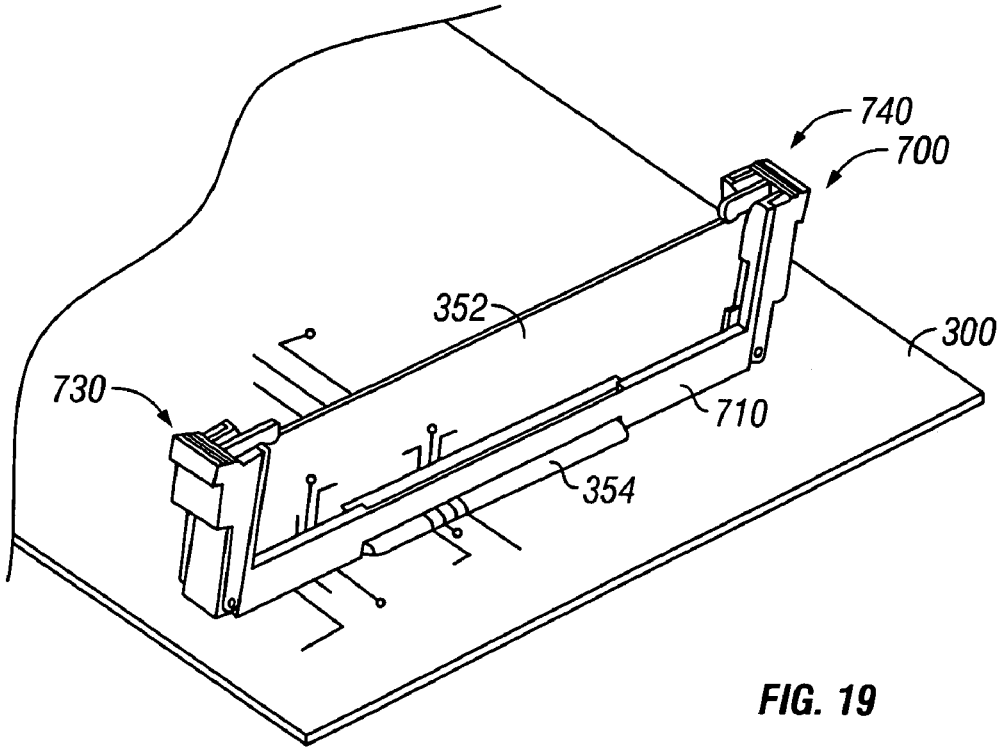
FIG. 19 shows a perspective view of the example socket of FIG. 18 securing the device relative to the circuit board.
Figure 20:
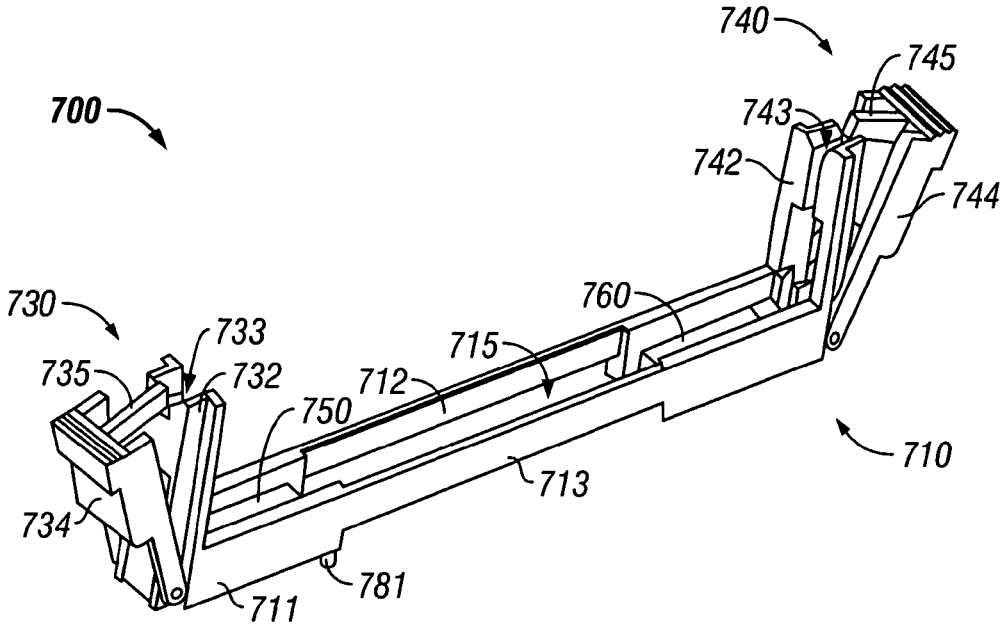
FIG. 20 shows a perspective view of a top and one side of the example socket of FIG. 18.

Circuit board 352 for one example has contact areas, such as contact areas 581, 582, 583, and 584 of FIG. 18 for example, conductively coupled to circuitry on circuit board 352 and positioned along the bottom edge of circuit board 352 on opposite sides of clamp 356 such that each such contact area is electrically coupled to connector 750 or connector 760 when circuit board 352 is mounted to connectors 750 and 760.

Figure 21:
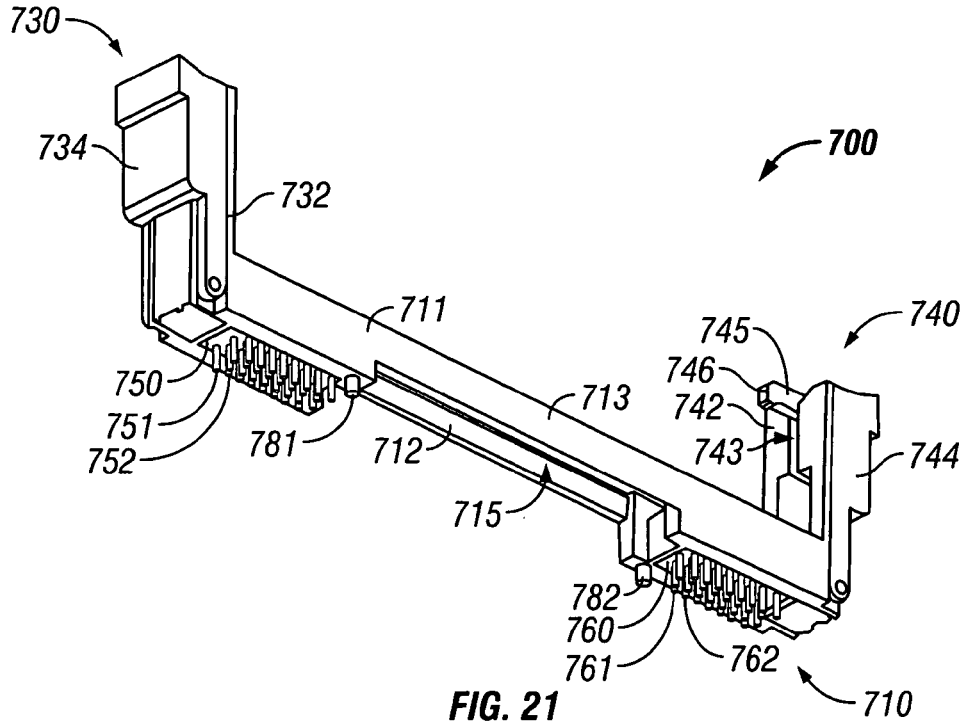
FIG. 21 shows a perspective view of a bottom and one side of the example socket of FIG. 18.
Figure 22:
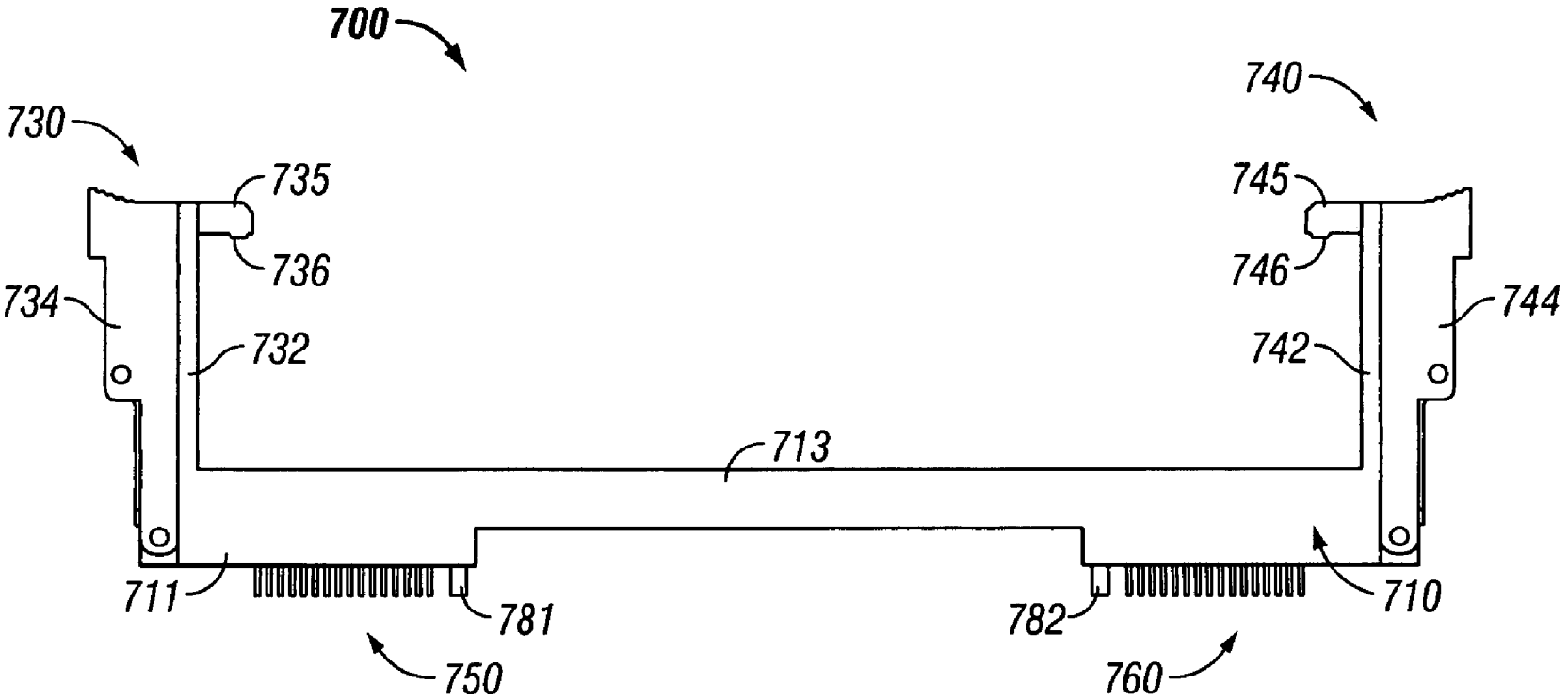
FIG. 22 shows an elevational view of one side of the example socket of FIG. 18.
Figure 23:
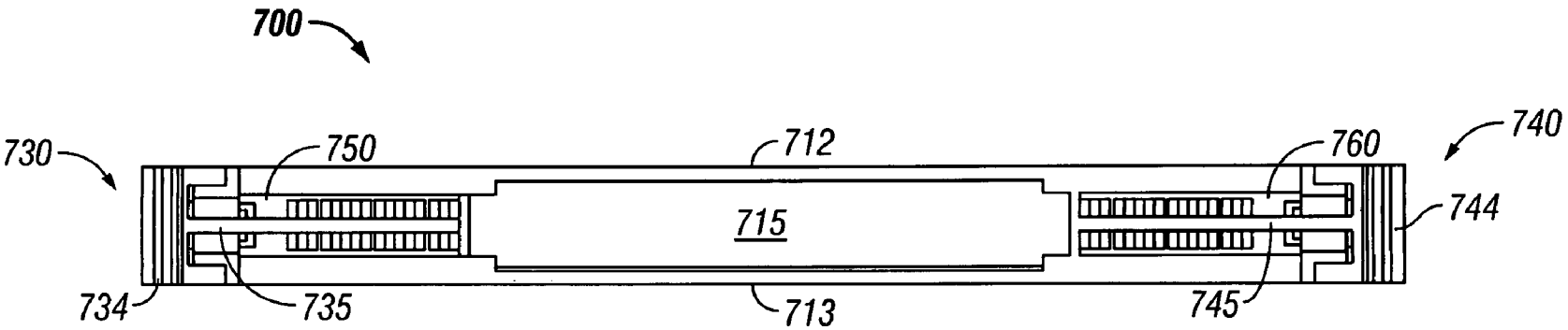
FIG. 23 shows a plan view of a top of the example socket of FIG. 18.
Figure 24:
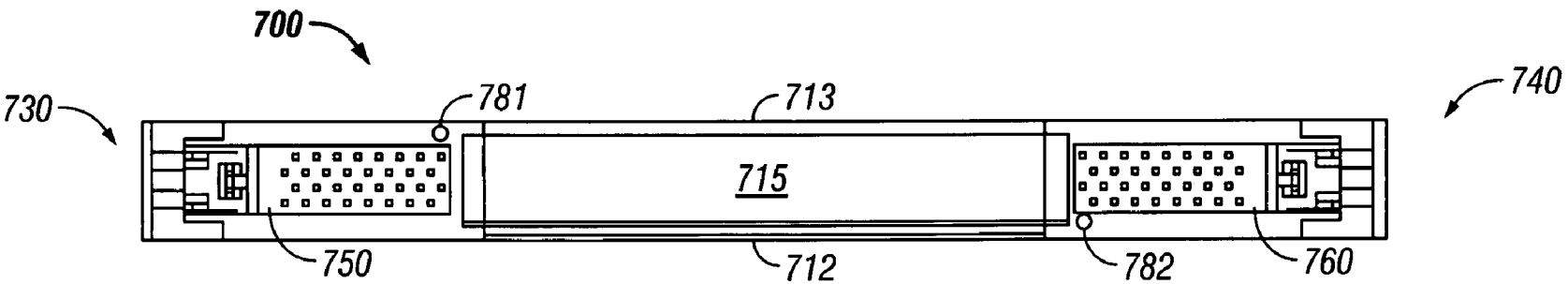
FIG. 24 shows a plan view of a bottom of the example socket of FIG. 18.

Connectors 750 and 760 for one example, as illustrated in FIGS. 21, 22, 24, and 25, each include contact pins, such as contact pins 751, 752, 761, and 762 of FIG. 21 for example, extending outward from the bottom of base 710. Base 710, and therefore socket 700, may be removably mounted to circuit board 300 by inserting the contact pins of connectors 750 and 760 into respective female connectors positioned on circuit board 300 such that conductive lines of flex circuit 354, when mounted in coupler region 715, are positioned relative to conductive lines on circuit board 300 to form an electromagnetic coupler.

Socket 700, as illustrated in the examples in FIGS. 20, 21, 22, 24, and 25, also includes optional locating and hold-down pins 781 and 782 each extending from the bottom of body 711 for insertion into corresponding openings of circuit board 300 to help align base 710 relative to circuit board 300 and to help secure base 710 to circuit board 300.

Circuit board 300 for one example includes circuitry conductively coupled to such female connectors. As connectors 750 and 760 for one example electrically couple the bottom edge contact areas of circuit board 352 to the contact pins of connectors 750 and 760, connectors 750 and 760 electrically couple circuit board 352 to circuit board 300 when base 710 is mounted to circuit board 300. In this manner, power signals, voltage reference signals, any other direct current (DC) signals, and/or any other signals may be supplied between circuit board 352 and circuit board 300.

Although described as including connectors 750 and 760 as having edge connectors and contact pins, other connectors may be used for mechanically mounting circuit board 352 to base 710 and base 710 to circuit board 300 and for electrically coupling circuit board 352 to circuit board 300. As one example, banana jack connectors may be used instead of edge connectors. In another example, high current mated pair connectors or impedance controlled mated pair connectors may be used.

Socket 700 in another example may not provide for any electrical coupling of circuit board 352 to circuit board 300. Connectors 750 and 760 may then include any mechanical connectors without concern for electrical coupling through connectors 750 and 760. In addition to or in lieu of any electrical coupling of circuit board 352 to circuit board 300 provided through connectors 750 and 760, circuit board 352 may be electrically coupled to circuit board 300 through flex circuit 354, for example, by coupling exposed conductive contact areas on flex circuit 354 and circuit board 300 in securing flex circuit 354 against circuit board 300.

Arms 730 and 740 secure circuit board 352 and flex circuit 354 relative to circuit board 300. As illustrated in FIGS. 20-25, arms 730 and 740 each include an upright guide 732 and 742, respectively, and a latch 734 and 744, respectively.

Upright guides 732 and 742 each engage circuit board 352 to help support circuit board 352 relative to circuit board 300 and to help minimize any angular displacement of circuit board 352 relative to circuit board 300. Upright guides 732 and 742 may extend from base 710 toward the top of socket 700 at opposite ends of base 710 and define slots 733 and 743, respectively, facing inward toward coupler region 715. In mounting circuit board 352 to base 710, opposite side edges of circuit board 352 are inserted into slots 733 and 743. In another example, upright guides 732 and 734 may engage circuit board 352 in any other manner. Although illustrated as being integrally formed with body 711, upright guides 732 and 742 in another example may each be a separate component connected to base 710 in any manner. In another example, socket 700 may not have upright guides 732 and 734.

Latches 734 and 744 each engage circuit board 352 to help secure flex circuit 354.against circuit board 300. Because of the shape and resiliency of flex circuit 354, flex circuit 354 exerts a force against latches 734 and 744 as well as against circuit board 300 when circuit board 352 and flex circuit 354 are mounted to circuit board 300 with socket 700. Latches 734 and 744 therefore help maintain a relatively stable coupling coefficient for the resulting electromagnetic coupler. Latches 734 and 744 may exert any amount of force against flex circuit 354, such as approximately ten to approximately twenty pounds of normal force for example.

Figure 25:
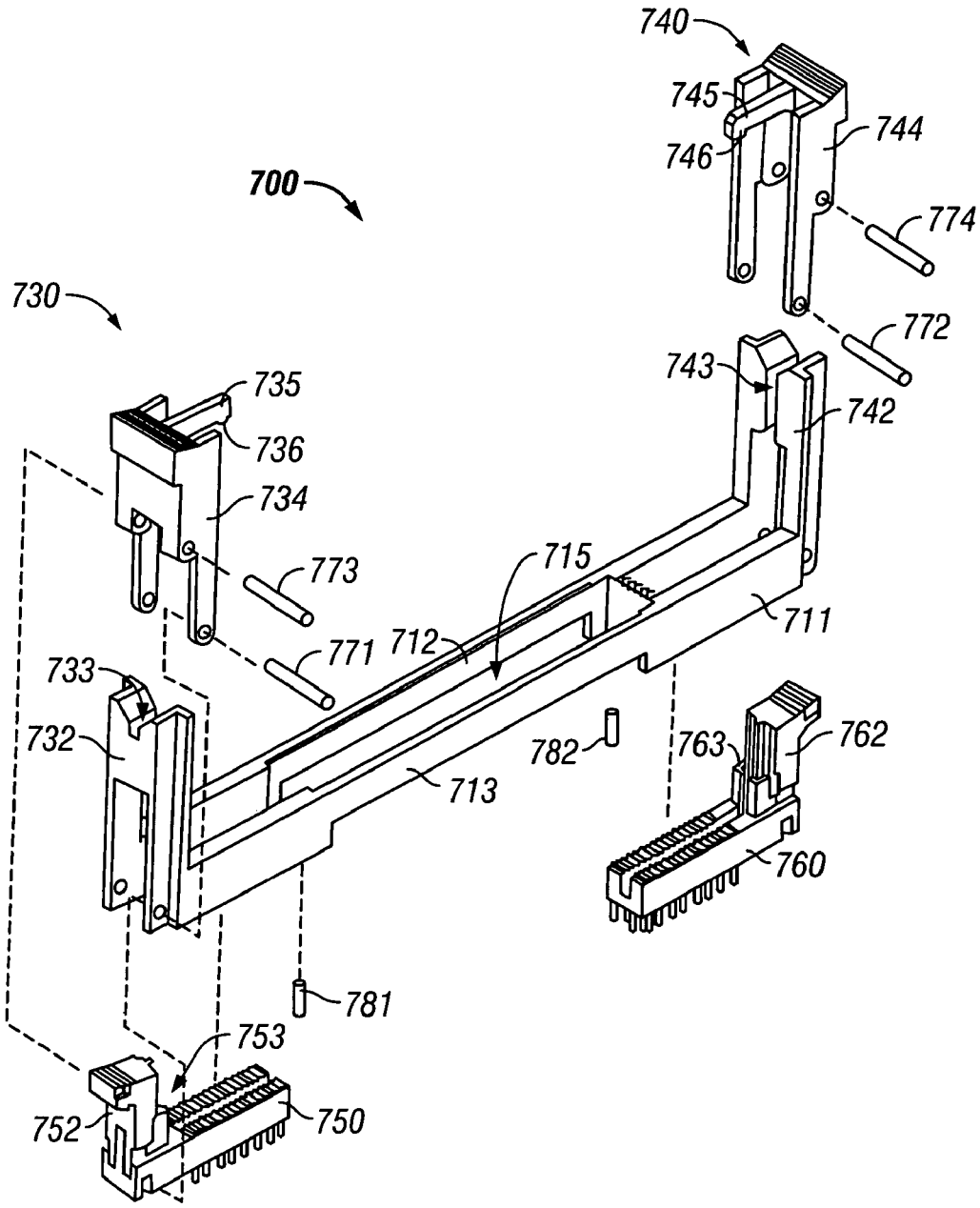
FIG. 25 shows an exploded perspective view of a top and one side of the example socket of FIG. 18.

Latches 734 and 744 in one example are pivotably mounted at opposite ends of base 710 such that each latch 734 and 744 may be pivoted inward toward coupler region 715 to engage circuit board 352 and outward from coupler region 715 to disengage circuit board 352. In one example, as illustrated in FIG. 25, latches 734 and 744 are pivotably mounted to base 710 and connectors 750 and 760, respectively, by pins 771 and 772, respectively, and to pivoting guides 752 and 762, respectively, of connectors 750 and 760, respectively, with pins 773 and 774, respectively, to help align latches 734 and 744 relative to connectors 750 and 760, respectively, and to circuit board 352.

Pivoting guides 752 and 762 each engage circuit board 352 when latching circuit board 352 with latches 734 and 744 to help support circuit board 352 relative to circuit board 300 and to help align circuit board 352, when mounted in base 710, with latches 734 and 744. Pivoting guides 752 and 762 in one example extend toward the top of socket 700 at opposite ends of base 710 and define slots 753 and 763, respectively, facing inward toward coupler region 715. Pivoting guides 752 and 762 pivot with latches 734 and 744, respectively. Slots 753 and 763 engage opposite side edges of circuit board 352 when circuit board 352 is mounted in base 710 and when latches 734 and 744 are pivoted inward to latch circuit board 352. In another example, pivoting guides 752 and 762 may engage circuit board 352 in any other manner. Although illustrated as a portion of each connector 750 and 760, pivoting guides 752 and 762 in another example may each form a portion of latches 734 and 744, respectively, or may each be a separate component connected to socket 700 in any manner.

Latches 734 and 744 in one example each define a finger 735 and 745, respectively, extending inward toward coupler region 715. Fingers 735 and 745 each define a knob 736 and 746, respectively, at their respective ends to engage respective notches or indentations 591 and 592 at a top edge of circuit board 352, as illustrated in FIG. 18, when circuit board 352 is mounted in base 710 and when latches 734 and 744 are pivoted inward. Fingers 735 and 745 therefore secure circuit board 352 and flex circuit 354 against circuit board 300. In another example, latches 734 and 744 may engage circuit board 352 in any other manner. As one example, fingers 735 and 745 may each engage a notch or indentation in opposite side edges of circuit board 352.

While circuit board 352 and flex circuit 354 are mounted to circuit board 300 by socket 700, walls 712 and/or 713 may help support flex circuit 354 relative to circuit board 300 despite any tendency by flex circuit 354 to roll to one side due to its shape and the force exerted on flex circuit 354 against circuit board 300 by latches 734 and 744. Walls 712 and/or 713 may therefore help align conductive lines of flex circuit 354 relative to conductive lines of circuit board 300. In another example, each interior face of wall 712 and/or 713 may be contoured in a relatively concave manner, for example, to help support the rolled shape of flex circuit 354 and help align flex circuit 354 relative to circuit board 300. Although illustrated as walls 712 and 713, socket 700 in another example may include one or more guide rails of any other shape, such as rods for example, to help support flex circuit 354. Socket 700 for another example may include only one or no guide rail adjacent to coupler region 715.

In addition to or in lieu of the use of walls 712 and/or 713 and/or alignment post 633, as illustrated in FIG. 15, to help align flex circuit 354 relative to circuit board 300, one or more other alignment techniques may be used. As one example, flex circuit 354 may be defined with one or more notches or indentations along one or each side of flex circuit 354 to engage corresponding guide pins or tabs at one or both opposite ends of coupler region 715. Such guide pins or tabs may extend from socket 700 inward toward coupler region 715 or from circuit board 300 into coupler region 715 when base 710 is mounted to circuit board 300. As another example, one or more guide pins or posts may extend from circuit board 300 into coupler region 715, when base 710 is mounted to circuit board 300, to engage corresponding openings in flex circuit 354. As another example, one or more guide pins or posts may extend from flex circuit 354 into corresponding openings in circuit board 300 when circuit board 352 and flex circuit 354 are mounted to circuit board 300.

To help maintain outer surface 355 of flex circuit 354 against circuit board 300 when circuit board 352 and flex circuit 354 are mounted to circuit board 300, relatively flexible or semi-rigid supports may be placed between the bottom of clamp 356 and the bottom interior surface of flex circuit 354. Such supports may include any material, such as foam, rubber, injection molded plastic, and/or an elastomeric material for example, and may be shaped in any manner, such as a brick, as a spring, or as springy fingers for example. In addition to or in lieu of such supports, a relatively springy material may be formed along the interior surface of flex circuit 354 to help maintain outer surface 355 of flex circuit 354 against circuit board 300. As one example, beryllium copper may be laminated along the interior surface of flex circuit 354.

To remove circuit board 352 and flex circuit 354 from socket 700, latches 734 and 744 may be pivoted outward from circuit board 352 to disengage latches 734 and 744 from circuit board 352. Circuit board 352 and flex circuit 354 may then be lifted from socket 700.

Each component of socket 700 may include any material and may have any dimensions. Body 711, upright guides 732 and 734, and latches 734 and 744 for one example may each include an injection molded plastic, for example. Base 710 for one example is approximately 5.55 inches in length, approximately 0.55 inches in width, and approximately 0.425 inches in height and defines coupler region 715 to be approximately 3.041 inches in length. Upright guides 732 and 742 for one example are each approximately 1.576 inches in height.

Although illustrated as mounted to circuit board 300 with socket 700, circuit board 352 and flex circuit 354 may be mounted to circuit board 300 using other mechanisms. As one example, a single connector and arm, similar to the combination of connector 750 and arm 730 for example, may be used. For another example, a clam shell clamp arrangement may be used to hold a flattened flex circuit 354 against circuit board 300.

Figure 26:
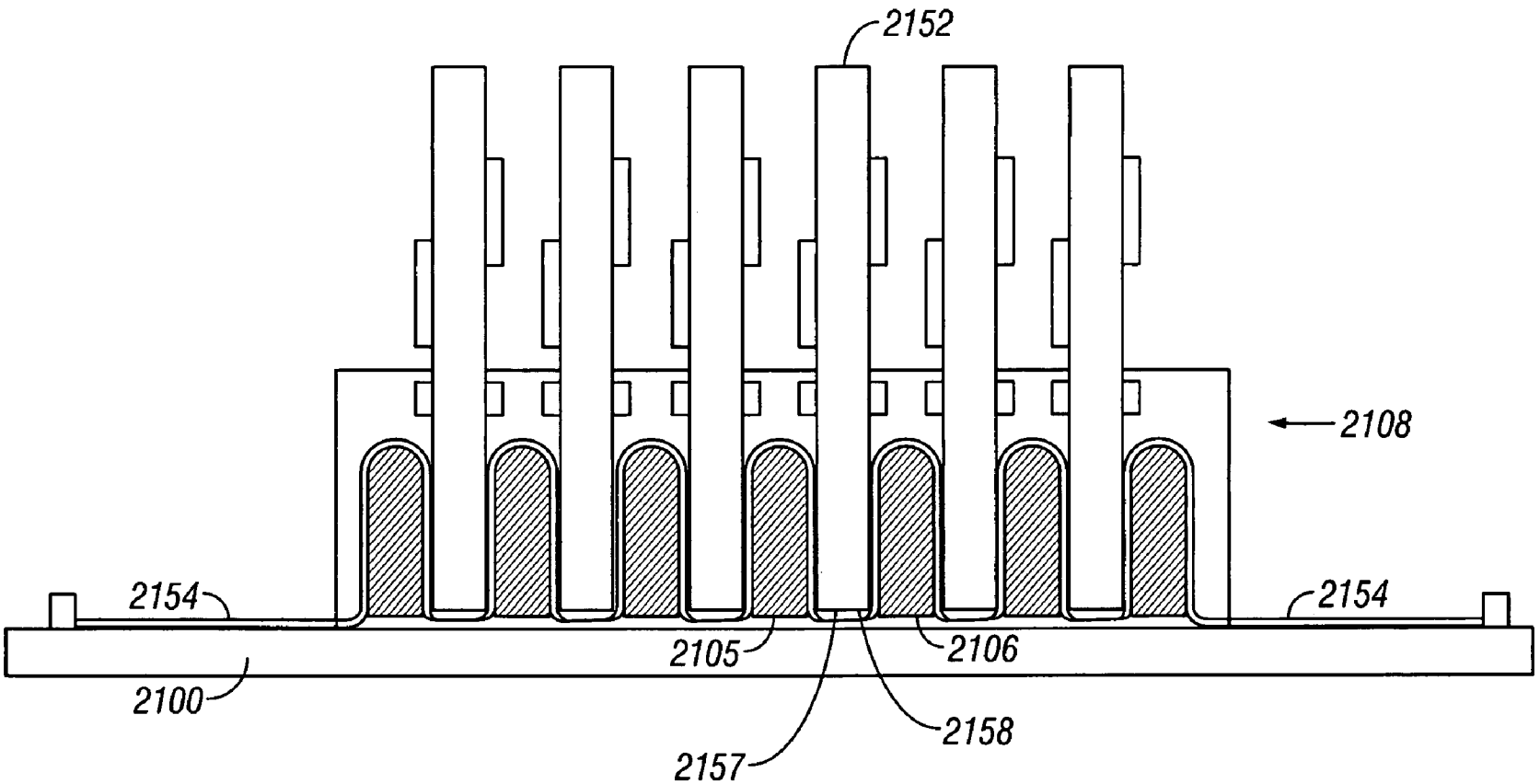
FIG. 26 shows an example of a plurality of devices electromagnetically coupled to a flex circuit of a circuit board.

As illustrated in FIG. 26, a circuit board 2152 for another example may be positioned relative to a flex circuit 2154 of a circuit board 2100 to form an electromagnetic coupler. Flex circuit 2154 includes one or more conductive lines for bus 112, for example, and may be similarly formed as flex circuit 354. Circuit board 2152 includes one or more conductive lines for bus 122, for example, that may be similarly formed on circuit board 2152 as conductive lines for circuit board 300, for example.

Conductive lines of flex circuit 2154 are conductively coupled to communication circuitry on circuit board 2100 and may be terminated in flex circuit 2154 or on circuit board 2100. Flex circuit 2154 may be conductively coupled to circuit board 2100 in any manner, such as through surface mount solder pads or a connector for example.

As illustrated in FIG. 26, flex circuit 2154 for one example is folded to form a coupler region 2157. Conductive lines of circuit board 2152 may be positioned relative to coupler region 2157 to form an electromagnetic coupler by positioning a surface of circuit board 2152 relative to coupler region 2157. Circuit board 2152 for another example may include other conductive lines for another bus such that positioning an opposite surface of circuit board 2152 relative to a coupler region 2158 of folded flex circuit 2152 forms another electromagnetic coupler. Flex circuit 2154 may be folded to form an electromagnetic coupler with any number of circuit boards, such as six, for example, as illustrated in FIG. 26. Although illustrated as being folded to form an electromagnetic coupler with circuit board 2152 positioned generally perpendicularly relative to circuit board 2100, flex circuit 2154 may be positioned in other manners to form an electromagnetic coupler with circuit board 2152 positioned in other manners.

In one example, flex circuit supports, such as supports 2105 and 2106 for example, may be used to support flex circuit 2154 in a folded position. Such supports may include any material. In one example, such supports include a resilient material to help hold circuit board 2152 against flex circuit 2154. Also, a circuit board guide 2108 may be used to help support and align one or more circuit boards relative to flex circuit 2154.

Other embodiments are within the scope of the following claims.

What is claimed is:

1. A system comprising:

an electromagnetic coupler that includes a flex circuit having a first conductor with a first length, an electronic board having a second conductor with a second length, a dielectric positioned to cover at least one of the first length and the second length and to allow alignment of the first length and the second length without contact between the first length and the second length, a visual element disposed along the first length of the first conductor and thereby enabling visual longitudinal alignment of the first length of the first conductor to the second length of the second conductor, and an adhesive material configured to adhere the flex circuit and the board, wherein the first length and the second length are in alignment with the flex circuit adhered to the board, and wherein one of the first length and the second length comprises a pattern having a lateral component that traces a path across the other of the first length and the second length with the flex circuit adhered to the board.

2. The system of claim 1 in which the adhesive material comprises a removable adhesive material that is configured to be removed after adhering the flex circuit and the board.

3. The system of claim 1 in which the electronic board includes a motherboard.

4. The system of claim 1 further comprising an epoxy blanket configured to fix the coupler to the board after the adhesive material adheres the flex circuit to the board.

5. The system of claim 1 in which the adhesive material includes tape.

6. The system of claim 1 in which the adhesive material includes a liquid or gel dielectric material configured to exert pressure and adhere the flex circuit to the board.

7. The system of claim 1 in which the electromagnetic coupler couples the first conductor to the second conductor with a coupler coefficient in the range of approximately 0.15 to approximately 0.45.

8. The system of claim 1, wherein the one of the first length and the second length comprises a zig-zaq pattern that zig-zags across the other of the first length and the second length with the flex circuit adhered to the board.

9. The system of claim 1, further comprising a mechanical alignment system that includes:

a first feature in the flex circuit;

a second feature in the electronic board; and a member to mechanically hold the first feature in alignment with the second feature.

10. The system of claim 9, wherein:

the first feature comprises a first hole in the flex circuit;

the second feature comprises a second hole in the electronic board; and the member comprises a cylindrical member that is insertable into the first hole and the second hole to mechanically hold the first hole in alignment with the second hole.

11. A system comprising:

a flex circuit including a first conductor having a first length;

a board including a second conductor having a second length;

a visual element disposed along the first length of the first conductor and thereby enabling visual longitudinal alignment of the first length of the first conductor to the second length of the second conductor; and an adhesive material configured to adhere the flex circuit and the board, wherein at least one of the first length and the second length is covered by a dielectric positioned to allow alignment of the first length and the second length and adhering of the flex circuit and the board without contact between the first length and the second length.

12. The system of claim 11 in which the visual element includes a fiducial mark.

13. The system of claim 11 in which the adhesive material comprises a removable adhesive material that is configured to be removed after adhering the flex circuit and the board.

14. The system of claim 11 further comprising an epoxy blanket configured to fix the flex circuit to the board after the adhesive material adheres the flex circuit to the board.

15. The system of claim 11 in which the adhesive material includes a compliant material configured to exert pressure and adhere the coupler to the board.

16. The system of claim 11 further comprising a visual element along the second length of the second conductor.

17. The system of claim 11 in which the first conductor comprises a first conductive line.

18. The system of claim 11 in which the second conductor comprises a second conductive line.

19. The system of claim 11 in which alignment of the first length and the second length and adhering of the flex circuit and the board couples the first conductor to the second conductor with a coupling coefficient in the range of approximately 0.15 to approximately 0.45.

20. The system of claim 11, wherein one of the first length and the second length comprises a zig-zag pattern that zig-zags across the other of the first length and the second length wiht the flex circuit adhered to the board.

21. The system of claim 11, further comprising a mechanical alignment system that includes:

a first feature in the flex circuit;

a second feature in the electronic board; and a member to mechanically hold the first feature in alignment with the second feature.

22. The system of claim 21, wherein:

the first feature comprises a first hole in the flex circuit;

the second feature comprises a second hole in the board; and the member comprises a cylindrical member that is insertable into the first hole and the second hole to mechanically hold the first hole in alignment with the second hole.

23. A system comprising:

an electromagnetic coupler that includes a flex circuit having a first conductor with a first length, an electronic board having a second conductor with a second length, a dielectric positioned to cover at least one of the first length and the second length and to allow alignment of the first length and the second length without contact between the first length and the second length, a visual element disposed along the first length of the first conductor and thereby enabling visual longitudinal alignment of the first length of the first conductor to the second length of the second conductor, and an adhesive material configured to adhere the flex circuit and the board, wherein, the first length and the second length are in alignment with the flex circuit adhered to the board, and wherein one of the first length and the second length comprises a zig-zag pattern having a longitudinal component that traces a path that zig-zags across the other of the first length and the second length with the flex circuit adhered to the board.

24. A system comprising:

a flex circuit including a first conductor having a first length;

a board including a second conductor having a second length;

a visual element along the first length of the first conductor and enabling visual longitudinal alignment of the first length of the first conductor to the second length of the second conductor; and an adhesive material configured to adhere the flex circuit and the board, wherein at least one of the first length and the second length is covered by a dielectric positioned to allow alignment of the first length and the second length and adhering of the flex circuit and the board without contact between the first length and the second length, and wherein one of the first length and the second length comprises a zig-zag pattern that zig-zags across the other of the first length and the second length with the flex circuit adhered to the board.

* * * * *